US005803964A

United States Patent [19]

Scarborough

[11] Patent Number: 5,803,964

[45] Date of Patent: Sep. 8, 1998

[54] COMPOSITE BUILDING MATERIAL AND SYSTEM FOR CREATING STRUCTURES FROM SUCH BUILDING MATERIAL

[75] Inventor: Walter W. Scarborough, Houston, Tex.

[73] Assignee: Sequoyah eXo Systems, Inc., Houston, Tex.

[21] Appl. No.: 534,839

[22] Filed: Sep. 27, 1995

Related U.S. Application Data

[63] Continuation-in-part of Ser. No. 242,412, May 13, 1994, abandoned, which is a continuation-in-part of Ser. No. 912,803, Jul. 13, 1992, abandoned.

[51] Int. Cl.[6] ..... C04B 14/38

[52] U.S. Cl. ..... 106/724; 106/737; 106/823

[58] Field of Search ..... 106/724, 737, 106/823

[56] References Cited

U.S. PATENT DOCUMENTS

| | | | |
|---|---|---|---|
| 3,329,750 | 7/1967 | Growald | 264/45 |
| 3,620,819 | 11/1971 | Croce | 106/733 |
| 3,922,413 | 11/1975 | Reineman | 428/119 |
| 3,949,144 | 4/1976 | Duff | 428/414 |
| 4,019,296 | 4/1977 | Jochmann | 52/268 |
| 4,047,962 | 9/1977 | Copeland | 106/DIG. 1 |
| 4,067,164 | 1/1978 | McMillan | 52/309.12 |
| 4,101,335 | 7/1978 | Barrable | 106/790 |
| 4,253,288 | 3/1981 | Chun | 52/454 |
| 4,254,019 | 3/1981 | Kroyer | 269/38 |
| 4,342,180 | 8/1982 | Gibson et al. | 52/741 |
| 4,398,960 | 8/1983 | Murray . | |
| 4,407,676 | 10/1983 | Restrepo | 106/657 |
| 4,455,170 | 6/1984 | LeGrand et al. | 106/724 |
| 4,486,993 | 12/1984 | Graham et al. | 52/262 |
| 4,774,794 | 10/1988 | Grieb | 52/309.7 |
| 4,788,803 | 12/1988 | Seitz | 52/82 |
| 4,823,534 | 4/1989 | Hebinck | 52/743 |
| 4,944,127 | 7/1990 | Clear | 52/309.12 |
| 4,975,396 | 12/1990 | Thiery | 501/90 |
| 4,985,080 | 1/1991 | Jung | 106/724 |
| 5,062,897 | 11/1991 | Katsumata et al. | 106/724 |
| 5,120,367 | 6/1992 | Smith et al. | 106/644 |
| 5,189,856 | 3/1993 | Windstrup | 52/309.9 |
| 5,234,754 | 8/1993 | Bache | 428/332 |
| 5,338,357 | 8/1994 | Takai et al. | 106/724 |
| 5,378,279 | 1/1995 | Conroy | 106/719 |
| 5,433,777 | 7/1995 | Sheppard | 106/400 |

FOREIGN PATENT DOCUMENTS

0417418A1 3/1991 European Pat. Off. .

OTHER PUBLICATIONS

Product Brochure, Foam Lock, by Pratt & Lambert Specialty Products, (date not shown).

Product Brochure, Enerbond DW, by Abisko Manufacturing Inc., (date not shown).

Product Brochure, Amhome, by Amhome USA, Inc., (date not shown).

Japanese Patent Abstract — "Production of Cement Light Weight Molded Article" Take et al., JP01–37478 (Feb. 8, 1989).

*Primary Examiner*—Paul Marcantoni

*Attorney, Agent, or Firm*—Vaden, Eickenroht & Thompson, L.L.P.

[57] ABSTRACT

The invention described includes a panel made of sheets of expanded polystyrene (EPS) that are held together by tensile connectors on each side of the panel and rebars that extend along the sides of the panel and are bent so that the rebars exert compressive forces urging the sheets of EPS into engagement. The invention also includes a novel concrete for coating the panels after they are arranged to form a structure. The concrete shrinks slightly to form a hard exoskeleton for the structure. A unique foundation for such structure is also enclosed where the panels provide the side forms for a slab of concrete and sand the bottom form.

2 Claims, 18 Drawing Sheets

FIG. 1
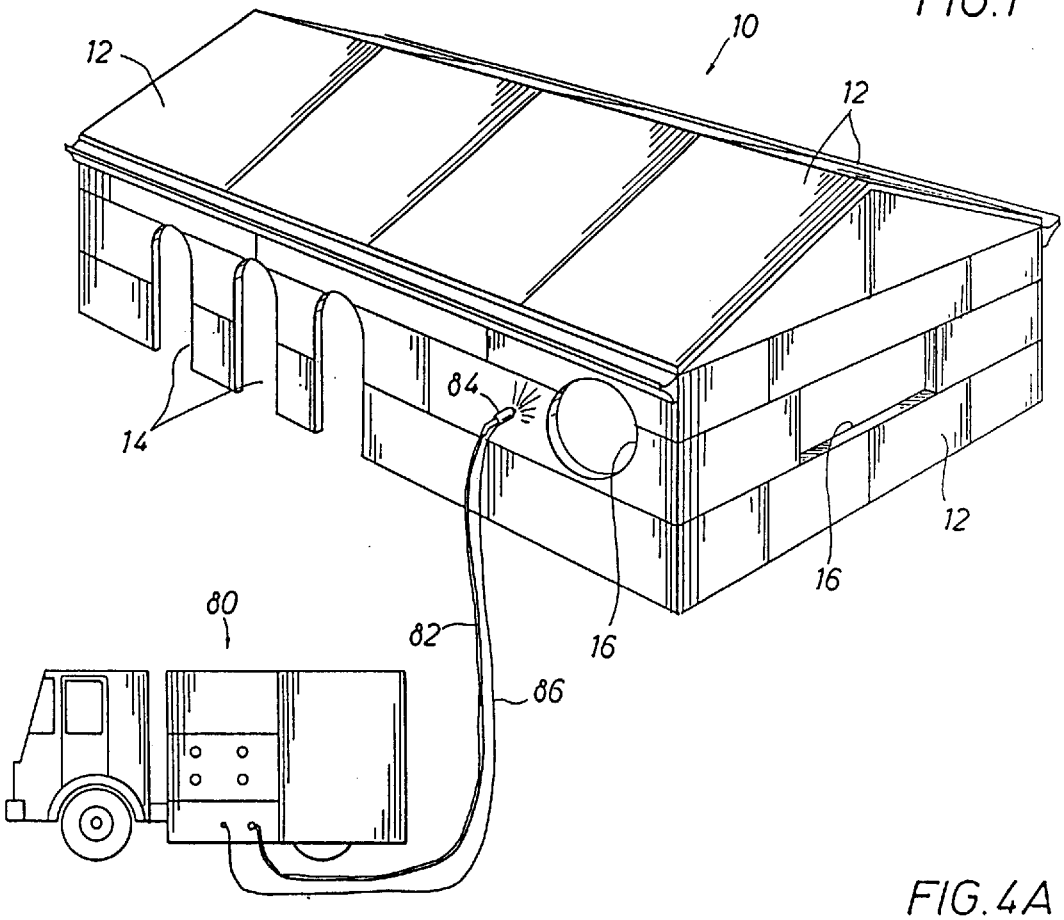
FIG. 4A
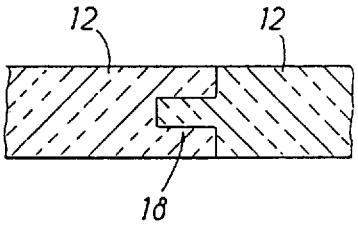
FIG. 4B
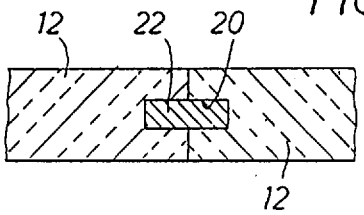
FIG. 4C
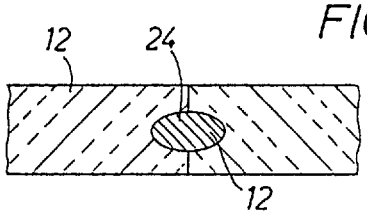
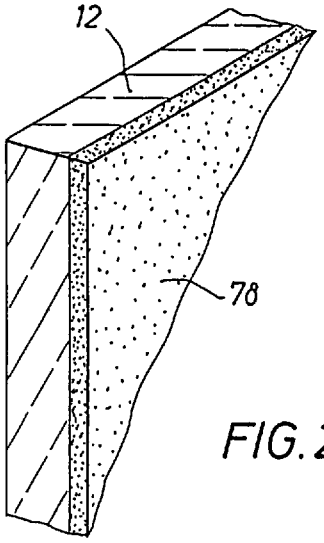
FIG. 2

FIG. 5
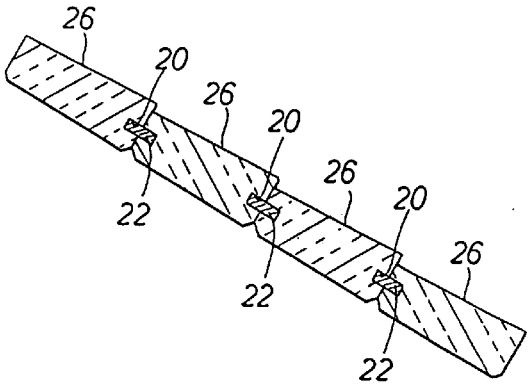
FIG. 3
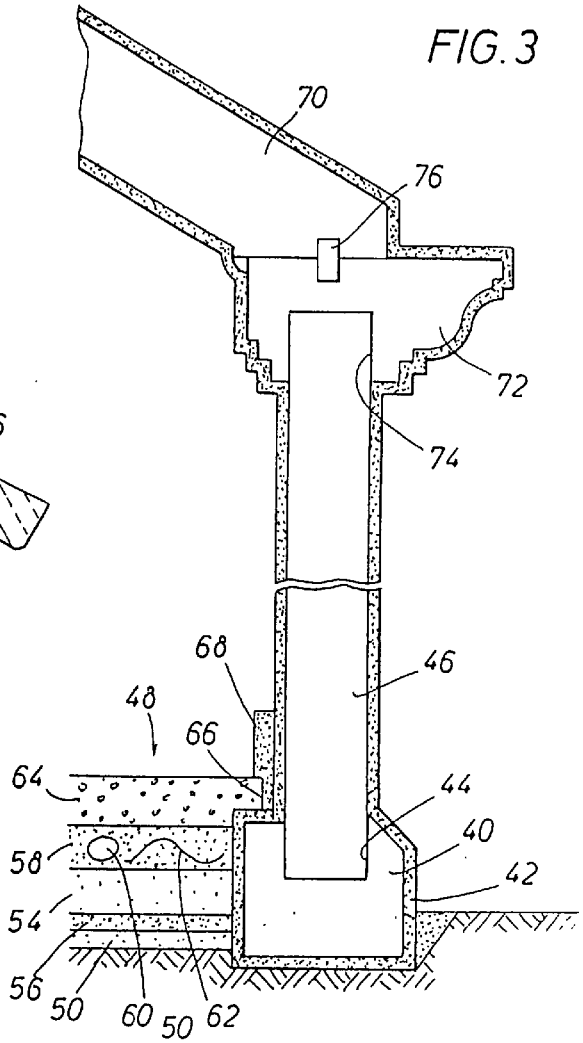
FIG. 6
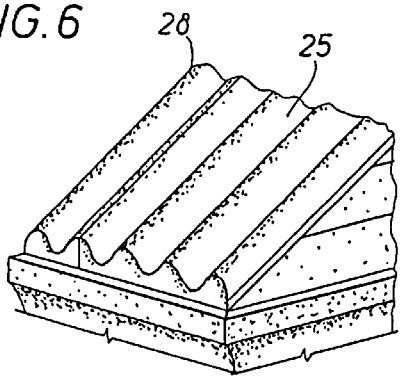
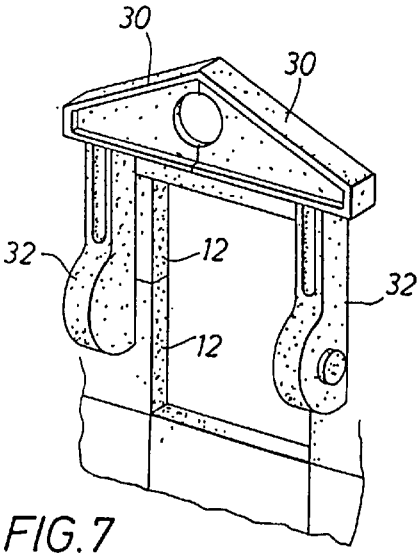
FIG. 7
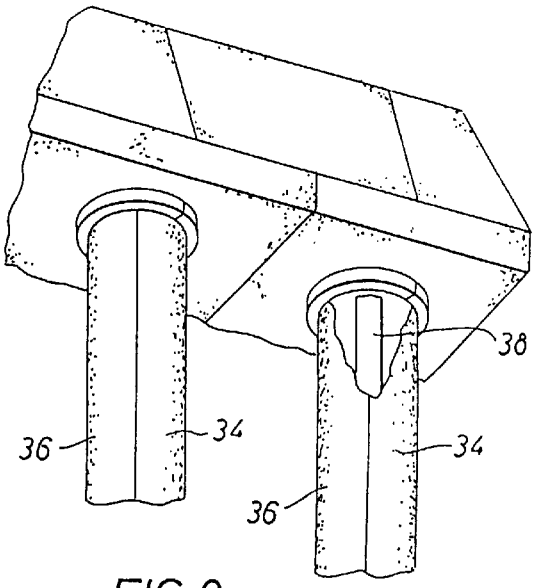
FIG. 8

FIG. 27
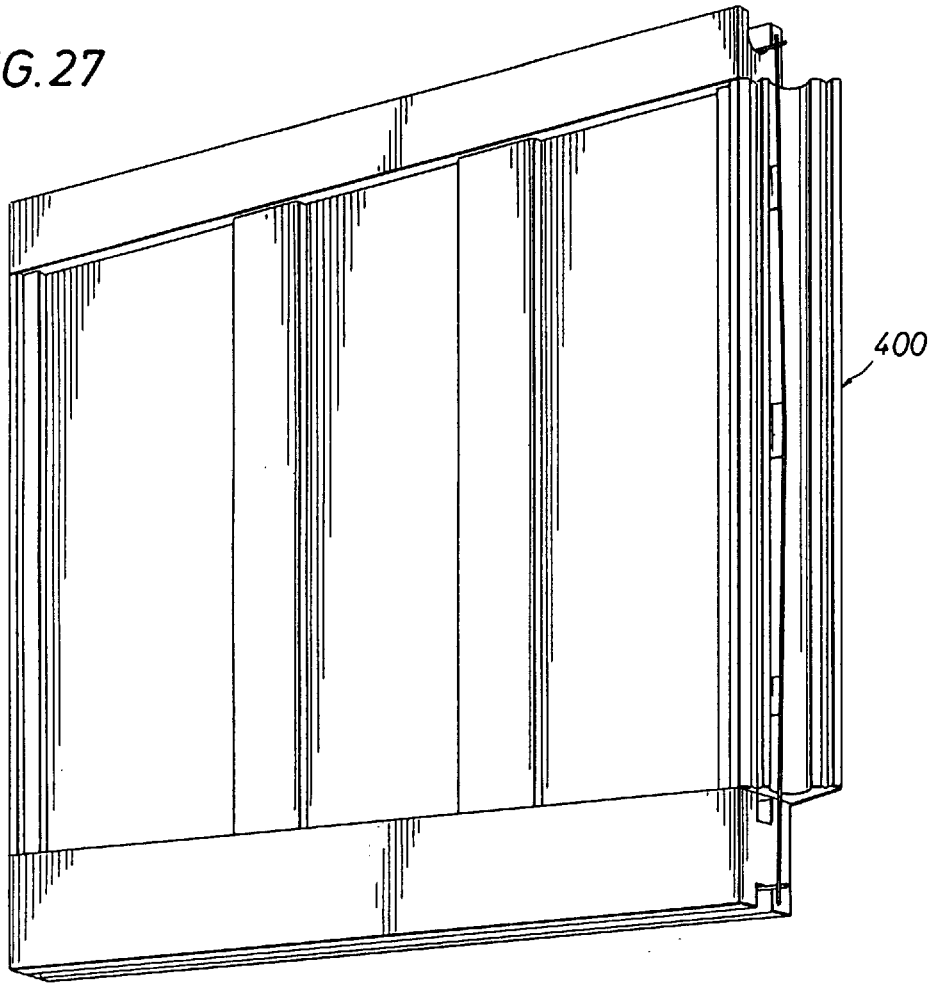
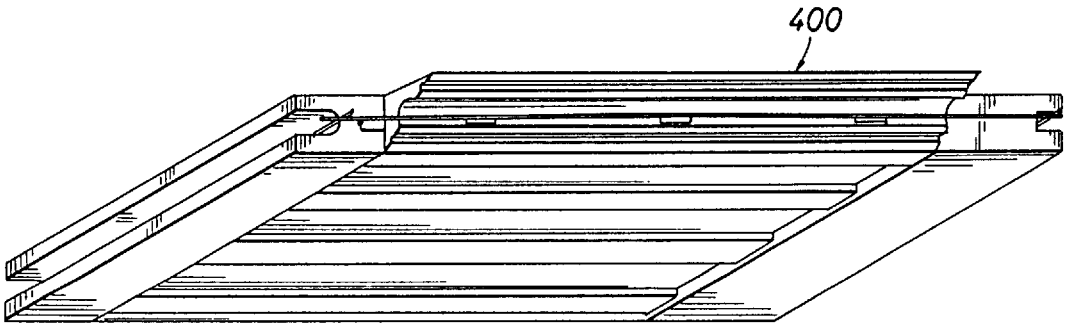
FIG. 28

FIG. 29
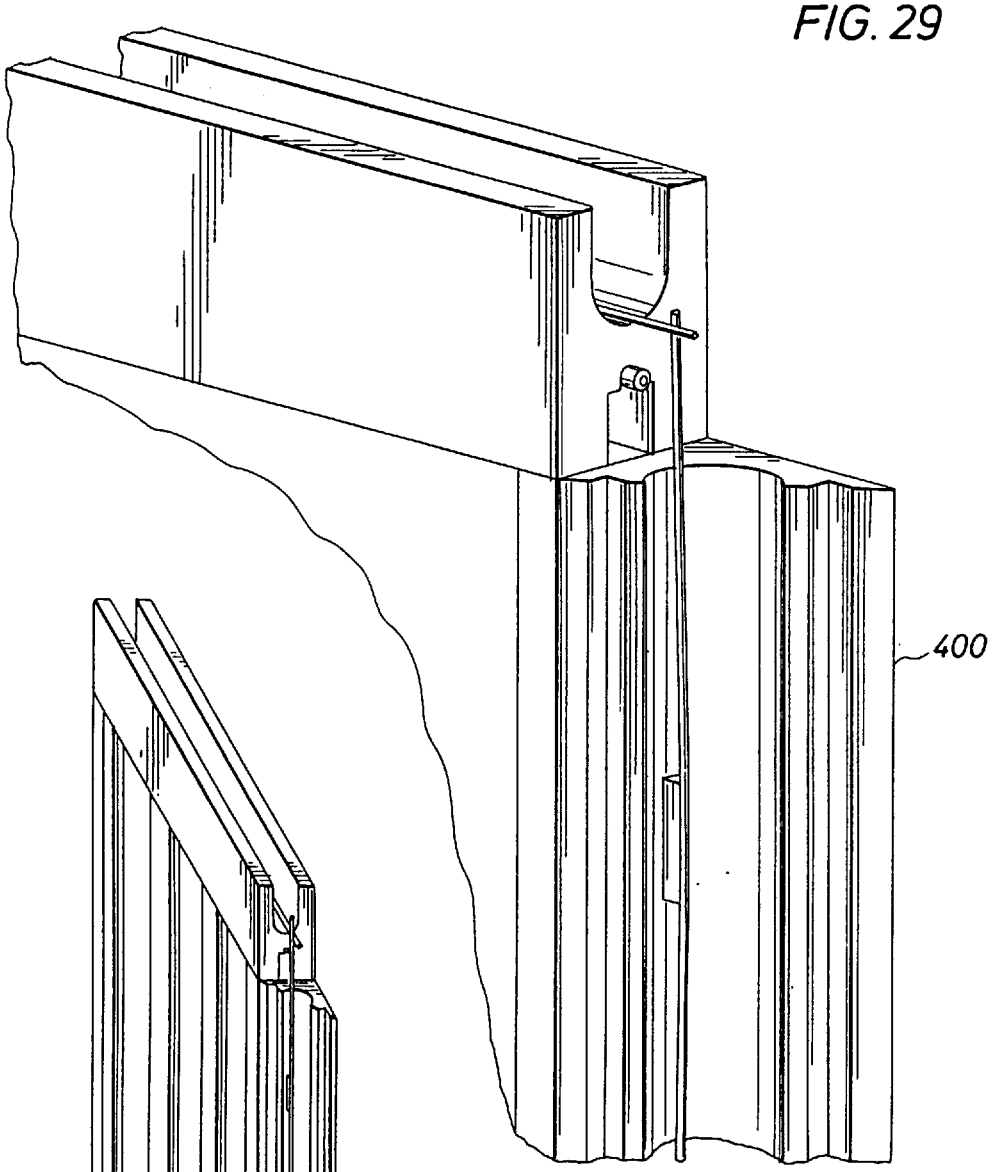
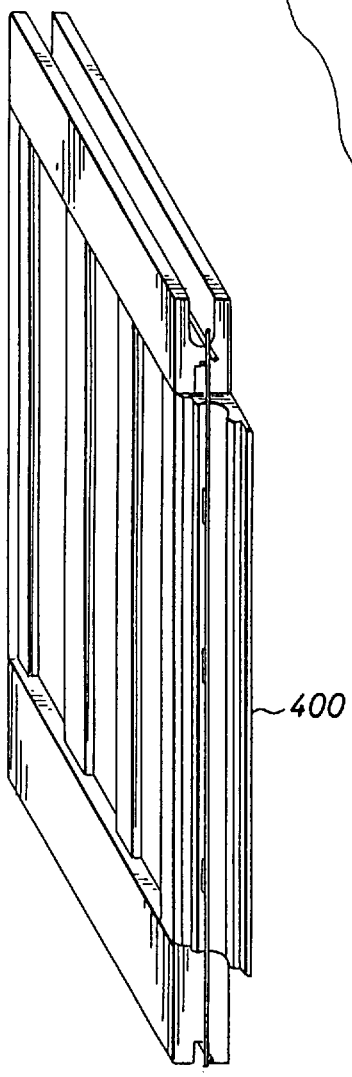
FIG. 30

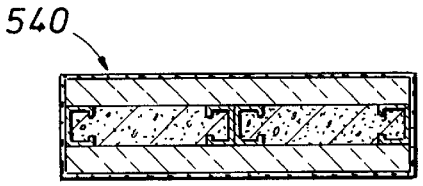
FIG. 33D
FIG. 33E
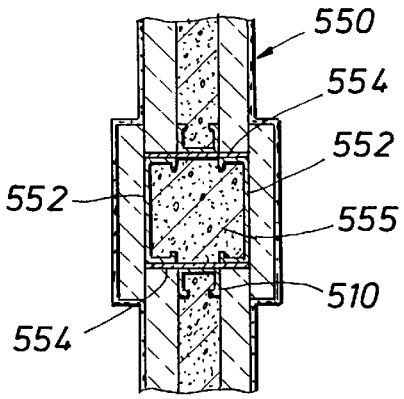
FIG. 33F
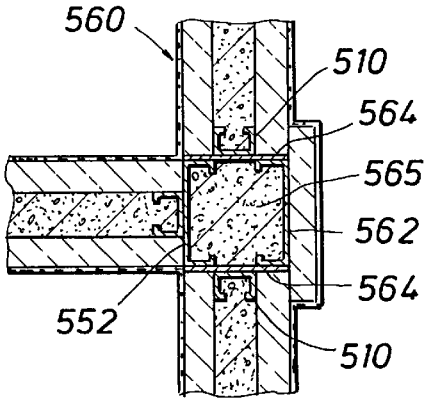
FIG. 34
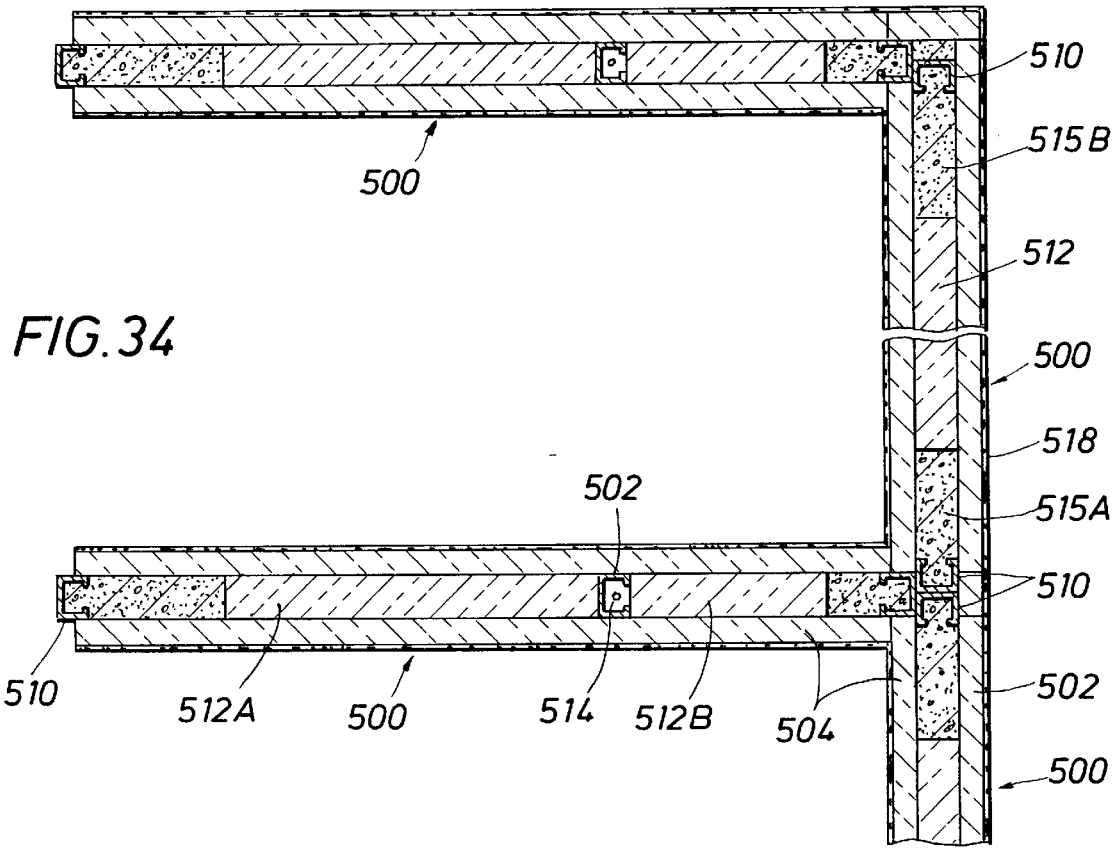

FIG. 35A
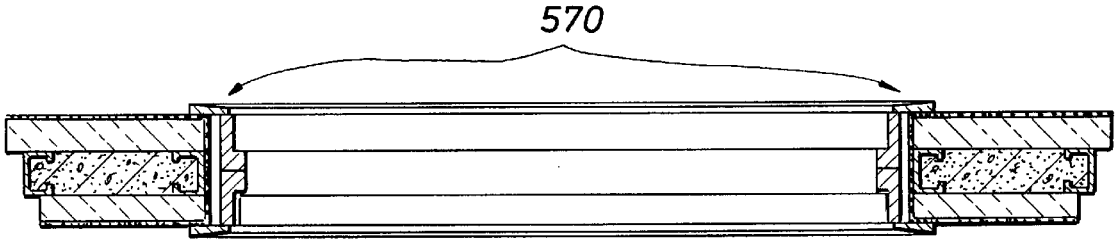
FIG. 35B
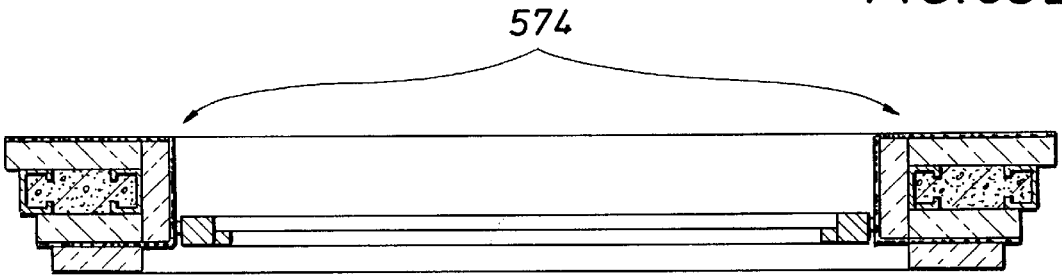
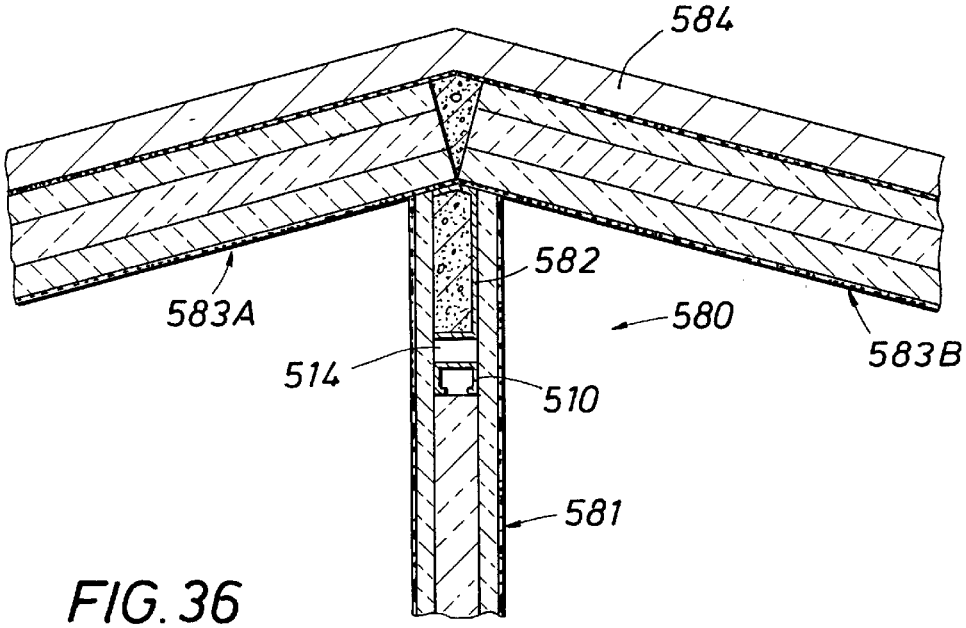
FIG. 36

COMPOSITE BUILDING MATERIAL AND SYSTEM FOR CREATING STRUCTURES FROM SUCH BUILDING MATERIAL

This is a continuation-in-part of application Ser. No. 08/242,412, filed May 13, 1994, abandoned, which is a continuation-in-part of application Ser. No. 07/912,803, filed Jul. 13, 1992 abandoned.

BACKGROUND OF THE INVENTION

This invention relates to building materials and, more particularly, to a composite building material formed of an expanded polymeric foam base and a concrete shell to form a monocoque or stressed skin structure, to a system for fabricating structures from the composite material, to the concrete that forms the shell, and to panels of expanded polystyrene used to construct the buildings.

Shelter is one of man's necessities. From its earliest days, mankind has constantly striven to find protection from the hostile forces of the environment. He (she) has used ingenuity in finding or creating shelter. Naturally-formed caverns provided shelter to early members of our species, and still do in some societies. A wide variety of man-made structures have been used, ranging from the simple and practical, such as lean-tos and igloos, to much grander examples as the palace built by Louis XIV at Versailles, the Taj Mahal, modern-day skyscrapers, and extensive interdependent housing units such as Habitat.

The search for building materials to satisfy the environmental and economic needs, balanced with aesthetic desires, has been an unending quest. While cost is always important, environmental concerns such as the deforesting of our planet for building materials and the conservation of finite sources of energy for heating and air-conditioning are becoming more important factors to consider.

With the world's population expanding and more people moving to densely populated areas, the need for new housing is a continuing and serious problem. This increased demand coupled with the escalating cost of energy has created the challenge of providing shelter that is both affordable to build as well as to heat and cool and that is less of a burden on the environment.

The present invention represents a merging of a number of technologies for meeting these modern-day needs for shelter. A novel composite building material has been developed that can easily be formed into an infinite variety of shapes and sizes, which is economical in cost as well as in its ability to reduce energy requirements. A unique system has been developed for fabricating structures from the composite material which utilizes a combination of known technology with novel application techniques, materials and apparatuses. In addition, a novel concrete has been developed that can be aerated or atomized.

SUMMARY OF THE INVENTION

The novel building material can be used to fabricate commercial buildings and new homes, as well as to reface existing buildings, and to form virtually any other type of structure. The entire structure is either formed of or covered with the novel material, including the roof in the case of a house. The novel material can also be used to form all or part of a foundation or slab on which the building is constructed. The material has characteristics that make it suitable for a wide variety of applications, because it can easily be formed into complex shapes. It also has excellent dimensional stability, design flexibility, and easy shipment and erection capabilities.

The inventive building material is a composite formed of a base of a dimensionally-stable, lightweight, strong material which has a high insulating factor, such as an expanded polymeric foam, preferably expanded polystyrene ("EPS"), with a concrete coating or shell applied directed to the EPS base.

It is known that polymeric foam materials are made by heating a gas that is trapped inside of small beads formed of a polymer. The heat makes the plastic malleable and causes it to stick together.

The foam material can be formed with a relatively high compressive strength, with the cost and strength being directly related to the weight of the material. EPS weighing one pound per cubic foot can bear weight at the rate of about 30 pounds per square inch. EPS weighing one and one-half pounds per cubic foot bears weight at about 45 pounds per square inch, while EPS weighing two pounds per cubic foot bears weight at about 60 pounds per square inch.

This expanded polymeric foam material has special applicability to building materials because it can be formed into simple as well as complex shapes through the use of the known technology of passing a nickel chromium wire, heated by an electric current, through the material at a rate that produces a desired amount of melt that burns a hole conforming to a predetermined pattern, which may be programmed into a computer. This characteristic allows structural designs to be made on CADD (computer aided drafting and design) equipment where all of the different pieces needed to build the structure are designed and specified. The CADD program can be transferred into a CAM (computer aided manufacturing) machine so the discrete pieces can automatically be made.

In addition to being easily shaped, materials such as EPS are also advantageous because they can be molded, they are light in weight, they can be made pest resistant through the use of additives such as Borax or Bromide when the foam is expanded, they can be formed in any number of colors, and they can easily be connected to a structural subsurface or to adjacent pieces of the same material. A significant advantage offered by this type of material is that it is extremely light in weight. Even relatively large sections can be formed off-site, transported and fitted together without the need for special lifting equipment.

The novel composite material of this invention has a coating or shell formed of a unique polymer concrete mixture. Although the concrete portion of the structure is relatively thin, it forms an extremely hard shell or exoskeleton that bonds tenaciously to the EPS base through the adherence of the concrete to the relatively rough outer surface of the EPS. Irregularities of various types could also be formed into the outer surface of the EPS through the use of chemical or mechanical means, to provide an even better bond. The concrete shell is formed of a unique mixture of cement, graded aggregate ranging from 0.1 inch in diameter (2.5 mm) to fine marble ($CaCO_3$) powder, fly ash, and polymer resin fortifiers, modulated with monofilament polymer fibers. The mix can be adjusted to provide a wide variety of surface finishes and textures as well as strength and flexural variations.

The concrete is sprayed onto the EPS base after the components are mixed and transported through a hydraulic pumping system, mounted on a novel vehicle which can be driven to the job site. The unique way of mixing and applying the concrete provides a way of forming the shell that is fast and virtually foolproof.

After a coating of ¼"–½" or greater is applied, the outer surface is sealed with a sprayed coat of polymer resin that is preferably mixed with sand in order to provide an appropriate viscosity for the pumps, which also apply the concrete shell. The sealer bonds to the cement and the polymer fortifiers in the concrete and makes a surface that is waterproof, slow to oxidize, resistant to ultraviolet light, can be formed in a variety of colors, fungus and mildew resistant, and is resistant to cracks. Pigment can be added to the structural coat to match the pigment in the sealer coat so that if any chipping or breaking should occur, the exposed shell will be the same color as the rest of the structure.

The concrete coating is applied over the entire structure. For example, in houses or other buildings the coating is applied to the EPS panels and pieces that form or cover the entire building. Vents are provided where considered desirable or necessary. As the concrete dries, it shrinks only slightly, since the novel mixture and spray application method eliminate most of the shrinkage inherent in polymer concretes. Nevertheless, the shrinkage that does occur results in a monocoque structure where the skin (concrete coating) is stressed in a manner used in race cars, jet planes and rockets, which greatly adds to the strength of the building.

It has been found that the concrete coating is still relatively soft 12 hours after being applied. This allows the material to be carved or shaped by various router-like tools to smooth the surface or form designs such as brick-shaped grooves. Further curing makes the concrete extremely hard.

The inner walls of the structure can also be coated in the same manner as the exterior wall. The aggregate in the concrete can be made finer so that a smooth plaster-like finish is provided.

For applications requiring greater structural strength, a steel or polymer panel can be added to the cement/foam composite on the side of the base opposite the concrete coating in order to operate as a beam.

Since the system for shaping the foam material does not recognize any difference in new or used subwalls and it has an inherent ability to provide shapes that can cover virtually any structural base, even pipes, gutters, and ornamental facades. The building material is user friendly for both architects and contractors alike. The novel material can also be used to form fences by supporting sections between galvanized steel posts. As can be appreciated, the material can be left plain or formed in any desirable decorative pattern.

The inventive material can be applied to many types of industrial buildings, which are typically formed of brick, tilt-up, or poured concrete walls. The EPS trim can be used to decorate the walls before the concrete shell is applied. The composite, which includes the shell panels, can be used for this type of building, or the EPS can be bolted directly to prepackaged building materials. Other applications of the inventive composite building material are movie and stage sets that can be quickly and cheaply erected and be formed in any variety of shapes and designs.

The inventive building material can also be formed into prefinished composite panels for the use as facades for high-rise buildings, with the panels being connected similarly to the precast facades that are presently used. The inventive material is extremely advantageous because of its low cost and light weight.

BRIEF DESCRIPTION OF THE DRAWINGS

The invention can be better understood by reviewing the detailed description of exemplary embodiments set forth below, when considered in conjunction with the accompanying drawings, in which:

FIG. 1 is a perspective view of a house formed entirely of expanded polymer foam sections in accordance with the invention, with the monocoque concrete shell being sprayed onto the outer surface of the house;

FIG. 2 is a partial sectional view of the composite structural material showing a piece of expanded polymeric foam coated on one side with sprayed polymer concrete in accordance with the invention;

FIG. 3 is a sectional view of one wall, and a portion of the foundation and roof structure of a building such as the one shown in FIG. 1;

FIG. 4 are three sectional views showing alternative ways of aligning adjacent sections of polymeric foam;

FIG. 5 is a sectional view of a portion of one embodiment of a roof formed in accordance with the invention;

FIG. 6 is an isometric view of another embodiment of a roof design;

FIG. 7 is an isometric view of a window made in accordance with the inventive method;

FIG. 8 is an isometric view of columns formed using the inventive method;

FIGS. 27–30 are four different perspective views of the panel of this invention;

FIGS. 33B–33F illustrate sectional views of specialized versions of the alternate panel of FIG. 33A;

FIG. 34 is a sectional plan view of connected walls of a building constructed of the alternate panel of the present invention;

FIGS. 35A and 35B are sectional plan views of the alternate panel applied to a door jamb and a window jamb, respectively;

FIG. 36 shows a partial sectional view in elevation of a ridge assembly formed of the alternate panels;

DETAILED DESCRIPTION OF EXEMPLARY EMBODIMENTS

Figure 9:
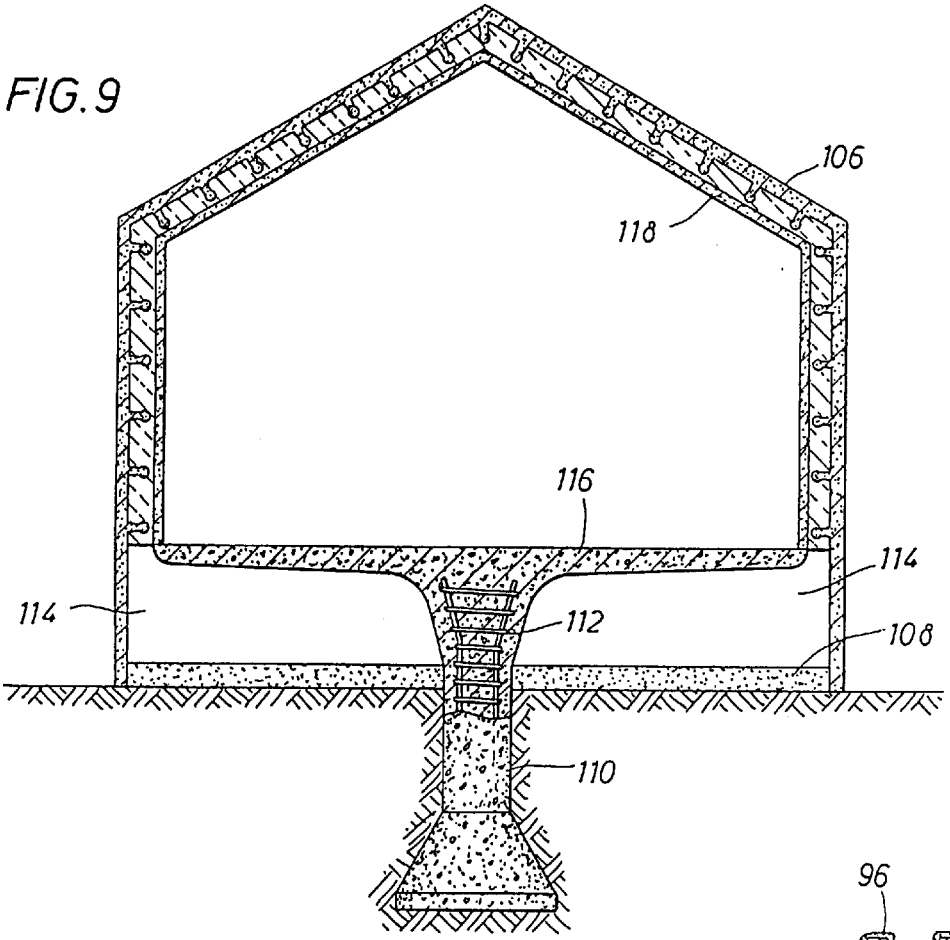
FIG. 9 is a sectional view of a house showing how the walls and roof can be reinforced and one embodiment of a foundation structure.

The invention includes a composite structural material that is useful for a myriad of structures, including new housing, retrofits for existing housing, industrial buildings, warehouses, roads, bridges, highway structures, walls, ramps, roofing, stairs, theme parks, movie and stage sets, furniture, sculptures and many other structures, a structure employing the building material, the concrete used in the manufacture of the composite building material, and a unique panel of EPS for forming the walls and other structural components of a building.

The novel composite material includes a core formed of an expanded polymeric foam or other suitable material with similar properties, preferably expanded polystyrene (EPS). The core is coated with a thin layer of a novel polymeric concrete material that is sprayed onto one or both outer surfaces of the EPS. The concrete coating forms an exterior or external shell or exoskeleton that becomes extremely hard when it cures, and because it shrinks slightly upon curing it forms a monocoque or stressed skin structure.

The inventive system involves the steps of designing the structure by specifying the shape and size of a number of panels of EPS that are fitted together to form the final structure. This type of design is specially suited for a CADD system where computers can be used for generating the designs and all of the specifications for each piece of the EPS as well as the overall design.

When the design is completed, the computer program can be applied to appropriate CAM equipment in the form of known machines that can cut EPS through the use of a nickel chromium wire heated by an electric current. An advantage of using EPS as a base material is that it can easily be formed into an infinite variety of detailed and complex shapes by such machines.

Building 10 of FIG. 1 is formed entirely of EPS sections 12 that are fitted together as described in greater detail below. The sections are preferably cut at a plant off-site and then transported to the job site so that they can be assembled into a structure such as house 10. Sections 12 can be trimmed or recut at the job site by using portable saws or hot wire equipment. Openings for doorways 14 and windows 16 are preformed so when foam sections 12 are assembled, they are appropriately located.

The process for cutting the expanded foam can be made accurate enough that adjacent sections will fit tightly against each other with a barely perceptible seamline, which will be covered when the concrete is sprayed onto the outer surface of the building. The joints can, however, be taped or floated to make sure that none of the seamlines show through the concrete coating.

It has been found that the EPS sections are easy to handle because they are light in weight and can be lifted and carried by one or two workmen depending on the size of the section. For example, the wall sections can be 4–8 inches thick and formed in sections that are 2–4 feet by 6– 8 feet. Roof sections are larger and preferably 12–18 inches thick. Interior walls can be used as beams for supporting the roof sections so that additional beams are not necessary. Of course, cross beams or supports can be used when additional structural support is needed.

In order to maintain the alignment of adjacent EPS sections, a tongue and groove shape generally designated by reference numeral 18, shown in FIG. 4A can be used on adjacent edges. Alternatively, adjacent sections could have their edges formed with grooves 20, which are filled with a rectangular key section or spline 22 between adjacent sections to provide the alignment as shown in FIG. 4B, or an oval key section or spline 24 can be provided as shown in FIG. 4C.

Roof sections can be formed of rectangular slabs of EPS as shown in FIG. 1, or of other alternate designs described below. One such alternative design is shown in FIG. 5 where adjacent wedge-shaped sections 26 span the roof in a horizontal direction with the sections being aligned through the use of keys 22 in adjacent grooves 22 as shown in FIG. 4B. Another roof design is shown in FIG. 6 where simulated tile-shape sections 28 of EPS are aligned lengthwise on the roof.

As shown in FIGS. 7 and 8, other structural details can be formed using EPS sections. For example, as shown in FIG. 7, window detail pieces 30, 32 can be applied to the outer surface of the house. In FIG. 8, columns can be formed of EPS sections 34, 36 for holding up roof sections. Steel or polymer poles 38 can be used in the center of the columns to provide additional structural support if necessary.

Adjacent EPS sections 12, or the detail or specially designed sections as shown in FIGS. 7 and 8, can be connected together through the tongue and groove, key or spline arrangements shown in FIG. 4 or they can be connected through the use of a suitable contact adhesive. Since the EPS can easily be punctured prior to the application of the concrete coating, it has been found that wooden or polymer dowels with sharpened ends can be used to hold adjacent pieces together. Since the EPS is so lightweight, minimum structural connection is necessary in order to hold the pieces together until they are bonded through the use of the concrete coating.

A foundation can be formed for the house 10 using any of the available techniques. Because of the lightweight EPS foam that is used to form all of the structural members of the house, the house needs to be anchored to the foundation. One method of providing such an anchor is shown in FIG. 3 where sill 40 formed of an EPS extends along each wall and is placed in an excavated trench after receiving a coating of sprayed concrete 42, applied as described in greater detail below. The sill 40 includes a groove 44 that receives wall section 46.

The foundation generally designated by reference numeral 48 is formed of a bottom layer of sand 50 which is laid on a prepared ground surface 52. A layer 54 of EPS, which has been coated with the novel concrete mixture 56, is laid on top of sand layer 50 and abuts the interior edge of sill 40. Another layer of sand 58 is formed on top of EPS layer 50, this layer including appropriate conduits 60, 62 for various utilities including water and gas pipes as well as electrical conduits. A poured slab 64 of reinforced concrete is then formed on top of layer 58 of sand.

An expansion space 66 is formed between slab 64 and the wall, with a baseboard section 68 formed of any suitable material for covering the expansion space.

Another method of providing a foundation for structures built using the panels of this invention will be described below in connection with FIG. 26.

Wall sections 46 are connected to roof sections 70 of EPS through crown section 72 that includes groove 74 for accommodating wall sections 46. Key 76 is fitted in grooves formed in the adjacent roof and crown sections 70, 72, similar to the arrangement shown in FIG. 4, for maintaining the alignment between EPS sections 70, 72.

Once building 10 is assembled as shown in FIG. 1, a novel concrete mixture is sprayed on the entire outer surface of the house, including the roof and all of the walls, in order to form an outer coating or shell 78, shown in FIG. 2. Because the outer surface of EPS sections 12 are relatively rough, the concrete adheres and tenaciously binds to the EPS. An even stronger bond can be formed by forming surface irregularities in the EPS, such as by spraying a solvent on the outer surf ace of the EPS or by mechanically forming irregularities.

Concrete coating 78 is sprayed onto the EPS as shown in FIG. 1. Truck 80 has been developed so the truck can drive up to the building site, which is an easy and convenient way of applying the concrete. The concrete mixture and all of the additives are mixed at the site by the truck apparatus, described in greater detail below, and then pumped through hose 82 to nozzle 84 where compressed air applied to the flowing stream of concrete through hose 86 provides a unique way of applying the concrete.

Mortar, plaster, grout, shotcrete (Gunite), stucco are used to form a hard covering for interior and exterior walls. They are mixtures of Portland cement and water that may include sand, as in the case of shotcrete and stucco, and sometimes a small amount of lime. Most of the material can be sprayed. Shotcrete, for example, is sprayed over a framework of reinforcing bars and steel mesh. The sand that is used in these mixtures is generally of uniform size and shape and therefore these materials are not "concrete".

Concrete is a hard strong building material made by mixing a cementing material (as Portland cement) and a mineral aggregate (sand and gravel) with sufficient water to cause the cement to set and bind the entire mass. Concrete gets its strength from the interlocking matrix formed by the different size of the aggregate. Specifically, the larger size aggregate create interstices that are filled with smaller sized aggregate that form interstices that are filled with even smaller sized aggregate, and so forth until the matrix is formed of interlocked aggregate from the largest size down to the smallest size, all of which are bound together by the cement.

It is an object and feature of this invention to provide a miniaturized sprayable concrete. In particular, the sprayable concrete mixture comprises Portland cement, "sharp" sand, fibers, water, and calcium-based and quartz aggregates ranging in size from powder to 0.1" (2.5 mm). Preferably, the quartz aggregates are on the greater end of the range, and approach 0.1" in size. The calcium-based aggregates may be pure calcium, XO-size (very fine) marble, O-size (fine) marble, or other suitable calcium-based materials. This type of concrete is "miniaturized" as the aggregates therein are very fine and do not exceed a size of 0.1" (2.5 mm). This enhances the sprayability of the mixture. The sizes of the individual aggregate particles in the concrete mixture are varied, within this range, to ensure the formation of the interlocking matrix between the particles within the mixture, as described above. Also, the smaller aggregate size results in a greater overall aggregate surface area for bonding with the cement/water paste, further improving the strength of the concrete mixture.

This concrete may further include polystyrene powder, and/or zinc sulfide which has been found to improve the insulating properties of the mixture, in addition to any one or all of the ingredients listed above.

One concrete mixture that has been found useful contains Portland cement, sharp sand, graded silicate aggregates, quartz aggregates, fine marble dust ($CaCO_3$), monofilament polymer fibers, lime and polymer resin polymers. A mixture which has been found particularly suitable is set forth below according to dry and wet component quantities:

| Dry Components | Weight (lbs) | Percent |
|---|---|---|
| No. 2-sized quartz and flint | 140 | 6.4 |
| No. 4-sized silicates | 200 | 9.1 |
| O-sized or XO-sized marble dust | 600 | 27.2 |
| Portland cement | 470 | 21.4 |
| sharp sand | 680 | 30.9 |
| fine lime | 100 | 4.6 |
| Polypropylene monofilament fibers | 10 | 0.4 |
| TOTAL OF DRY COMPONENTS | 2200 | 100.0 |
| **Wet Components** | **Volume (gal)** | **Percent** |
| vinyl acrylic polymer fortifier | 13.1 | 43.7 |
| water | 16.9 | 56.3 |
| TOTAL OF WET COMPONENTS | 30.0 | 100.0 |

The vinyl acrylic polymer fortifier is a powdery liquid polymer that is dissolved in water to form a polymer fortifier matrix, similar to latex wall paint. Such polymer fortifiers can be purchased from Rohm & Haas Texas, Inc. at its Deer Park, Tex. office, under its trademark: "Rhoplex MC-76."

The fibers are formed of virgin (non-processed) homopolymer (single-polymer) polypropylene with a length ranging from ⅛" to ½", with a specific gravity of approximately 0.91. The density of the fibers is much greater than that suggested in the prior art. In the above-described embodiment, 10 lbs of fibers is used in the mixture as compared to 1.5 lbs of fibers in a comparable volume of a prior art concrete. This embodiment, which is set forth in quantities producing roughly one cubic meter of concrete, therefore contains approximately 100 million fibers per cubic meter. This translates to a fiber density of 1639 fibers per cubic inch of concrete. The fibers are preferably of ¼"

and ½" lengths in about a 50/50 ratio, i.e., 50 million of each length per cubic meter of the concrete mixture. The shorter fibers provide a better dispersal and more even distribution of the resulting fiber netting (described more below) in the mixture. Such fibers can be purchased from the FIBER-MESH® division of Synthetic Industries, headquartered in Chattanooga, Tenn.

The concrete is mixed in the truck and pumped through a hydraulic pump described in greater detail below such that a pressure of 75 lbs. per square inch is maintained in the 1 inch diameter hose 82. Compressed air is pumped through the hose 86 at 75–165 lbs. per square inch, so that the concrete mixture is sprayed as an aerated slurry onto the outer surface of the EPS panels 12. It has been found that spraying provides a combination of aerating, dehydrating and cooling of the concrete during the time it leaves the nozzle to the time it is deposited onto the outer surface of the panels 12. Spraying also enhances the venting of hydrogen gas from the concrete mixture that is formed during the combination of water and cement (discussed further below). The sprayed concrete adheres to the outer surface of the panels 12 and can be applied in thin layers by passing the nozzle 84 back and forth across the panels 12.

The size of the sand can be varied in order to change the texture of the coating. The marble dust is believed to cause the mix to coagulate and to create a fine aggregate that resists shrinkage of the polymer concrete as it cures, which enhances the non-shrinking characteristic caused by spraying. Marble aggregate is used in greater quantities than ever suggested by the prior art, preferably in the form of marble dust. The cement, CaCO, is combined with water in the mixture to create a cementaceous matrix similar to limestone. The calcium in the marble aggregate, which is crystalline $CaCO_3$, accelerates the "set-up" of the cement once the water has been added, enabling the cement matrix to assume a stronger shape before being deformed by the polymer fortifier matrix. The marble also absorbs the heat of reaction that is created by the combining of the cement, CaCO, with the oxygen from two water molecules. This heat absorption by the marble significantly reduces the expansion of the cement matrix by the hydrogen gasses and other trace gasses released by the combination reaction.

Conventional concrete is formed in accordance with the following chemical equation:

$$CaCO+2H_2O \rightarrow CaCO_3+2H_2+\text{heat}.$$

The concrete of the present invention, by contrast, is formed in one embodiment according to the following equation:

$$CaCO_3+CaCO+2H_2O \rightarrow 2CaCO_3+2H_2+\text{heat}.$$

The same amount of heat is created in the exothermic reactions represented by both equations, but there are two molecules of $CaCO_3$ in the mixture of the present invention for every molecule of $CaCO_3$ in conventional concrete. Other embodiments contemplate the use of even more marble aggregate in the mixture. Preliminary tests indicate that the optimum range is 120–130% by weight of marble aggregate per weight of cement in the mixture. The resulting increase of $CaCO_3$ molecules significantly enhances the ability of the cementaceous matrix to dissipate the heat of reaction and therefore control the temperature rise and expansion of the hydrogen gas released by the reaction.

Figure 18A:
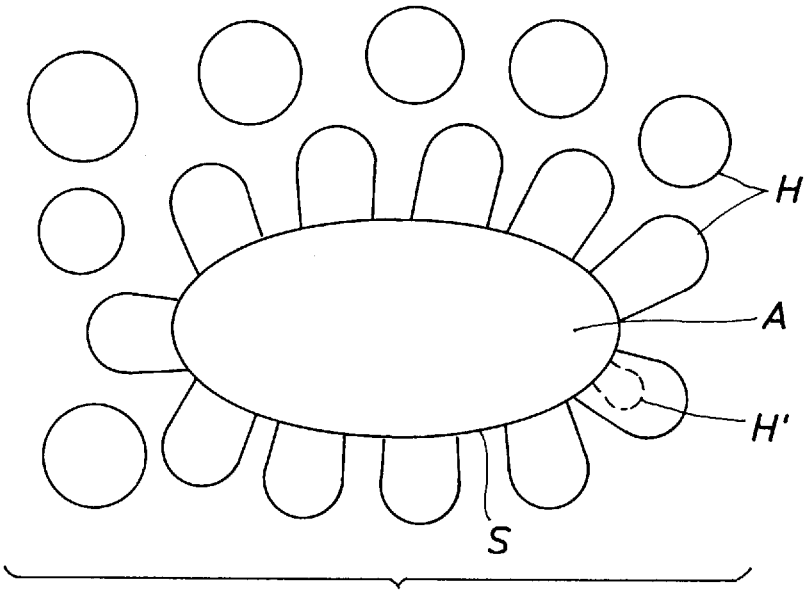
FIG. 18A is a magnified representation of hydrogen gas bubbles formed about an aggregate in conventional concrete.

FIG. 18A is an illustration of hydrogen gas bubbles H formed about aggregate A by the combination of water and cement in the prior art. The heat of reaction results in the formation of large bubbles that inhibits the amount of surface area S of aggregate A that is available for bonding with the cementaceous matrix surrounding the aggregate.

Figure 18B:
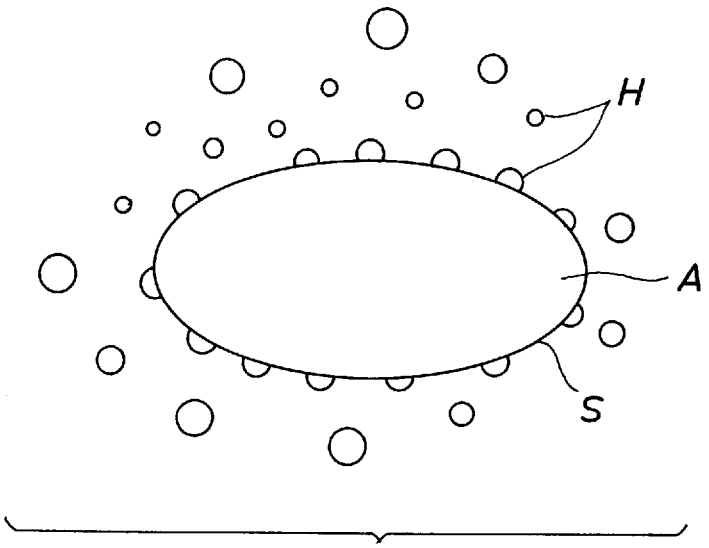
FIG. 18B is a magnified representation of hydrogen gas bubbles formed about an aggregate in a cementaceous matrix according to the concrete mixture of the present invention.

By contrast, FIG. 18B illustrates hydrogen gas bubbles H formed during the reaction of cement with water in the marble aggregate-rich mixture of the present invention. The hydrogen gas bubbles in the cementaceous matrix do not expand significantly and much more of the aggregate's surface area S, up to four times as much as in conventional concrete, is exposed to the cementaceous matrix for bonding therewith. The resulting concrete is more dense and more uniform throughout than conventional concrete products. Less cement is therefore required per volume to achieve the desired strength, because the increased density provides for better "gripping" of the short polypropylene fibers. Furthermore, the increased density results in a finished product that is thermally stabilized, i.e., it is slower to react to heat gain or heat loss.

Thus, the thermal expansion of the hydrogen gas bubbles in the present invention is limited because, due to the cooling effect of the increased $CaCO_3$ in the mixture, the hydrogen bubbles do not experience high temperature swings. This is contrasted with conventional concrete, wherein the heat of reaction is concentrated in 50% fewer molecules of $CaCO_3$, or less, and results in significant expansion of the gas bubbles and subsequent contraction as the heat is gradually transferred to the surrounding environment. This is shown by hydrogen gas bubbles H and H', respectively, in FIG. 18A. As the hydrogen bubbles cool and contract in size, cracks may be formed in the cementaceous matrix that weakens the resulting structure. Such crack formation is much less likely to occur in the present invention.

Quartz is preferred as the largest aggregate compound for use in bonding with the cementaceous matrix because the resulting increase in exposed aggregate surface area, as seen in FIG. 18B, produces a greater bond between the aggregate and the cementaceous matrix. The matrix then applies greater shear forces to the aggregate when the heat of reaction is dispersed among the $CaCO_3$ in the matrix to produce thermal "movement" of the matrix. The hardness of quartz is well suited for withstanding the increased shear.

The fibers are believed to hold the mixture together during the spray process as well as to provide flexibility to the mixture after it has been applied in order to resist cracking due to shifting in the building. The fibers produce a third, cloth-like netted matrix within the cementaceous matrix that is shatter resistant because shock waves transmitted to the concrete are absorbed by the polypropylene monofilament (fiber) netting. The finished concrete product is supple and flexible, and can receive sheet metal screws or nails because of the density of the cement matrix, the inherent qualities of the fortifying polymer matrix, and the netting of the polypropylene monofilaments.

The unique combination of the mixture and the application through a spraying process provides an extremely strong shell for a typical building 10, which shrinks slightly without cracking upon application in order to give a pre-stressed skin or monocoque coating to the building. Shrinking is reduced during the curing process because the expansion of hydrogen and other gasses in the mixture is significantly reduced.

Within twelve to twenty-four hours after the initial spray, the coating 78 has hardened but is still soft enough to carve. This allows the use of tools to carve various designs in the outer surface of the coating 78 or the use of grinding equipment in order to smooth the coatings. For example, an initial base coat could be applied of a gray color, with an outer coat of the concrete which has a reddish hue. By carving grooves to expose the gray coat underneath would provide a surface finish that had the appearance of brick.

Various layers can be applied to the EPS sections 12 at any point in time since the vinyl acrylic will polymerize with the acrylic in the preceding layer so that one continuous layer is provided even though it is applied at different times.

A pigment can be added to the concrete as it is mixed in the truck 80 so that it has the color which is desired for the building. After the initial coat 78 has cured, an outer sealer coat formed of an acrylic paint can be applied which is the same color as the pigment in the base coat. Thus, if the outer coat is fractured in some way, it would not be readily apparent since the base has the same color.

Various door and window units (not shown) are mounted in the openings 14, 16 either before or after the spraying process. Aluminum windows can be attached to the concrete with screws. Nevertheless, since the EPS panels have such a high insulating rating, extruded vinyl frames are preferable so as not to provide any type of significant conduction from outside the house to inside the house after windows are applied. Also, double-glazed windows are preferable because of the greater insulating effect they have. Appropriate ventilation holes can be provided under the eaves of the house (not shown) so that adequate air circulation is provided inside.

Figure 11:
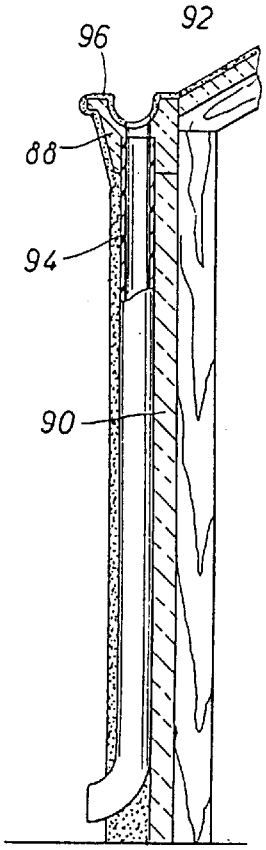
FIG. 11 is a sectional view of a gutter and downspout formed of the inventive material.

As shown in greater detail in FIG. 11, gutters can be formed by providing gutter sections 88 that interconnect with wall sections 90 and roof sections 92, which interconnect with PVC pipe sections 94. These sections are covered with a layer of sprayed concrete as described above, designated by reference numeral 96, which encloses all of the sections and provides an attractive facade for the gutters and downspouts.

Figure 10:
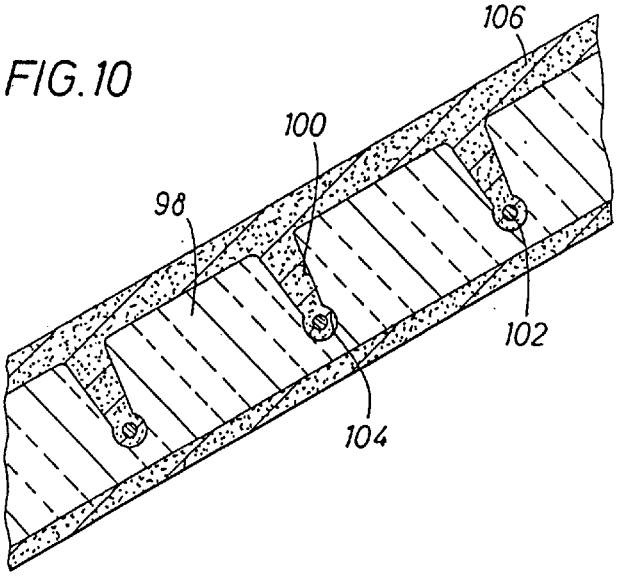
FIG. 10 is a partial sectional view of a reinforced beam formed of the inventive material.

The composite material can also be used to form structural sections which are greatly reinforced, as shown in FIGS. 9 and 10. In this type of structure, foam sections 98 are formed with V-shaped grooves 100 spaced along their outer surface. Reinforcing rods 102 are provided through channels 104 formed on the inner edge of the notches 100, such reinforcing members being formed of any suitable material such as, for example, steel rebars, synthetic fibers such as Kevlar or even bamboo.

A coating of the sprayed concrete material designated by reference numeral 106 is applied to the outer surface of the EPS sections which also fills up the V-shaped notches and the openings 104. When the concrete cures, an extremely strong reinforced foam section is formed.

As shown in particular in FIG. 9, such sections can be used to form the shell of a house which is mounted on a foundation also formed of the composite material. The foundation includes a layer of sand or fine aggregate 108 formed on prepared earth. One or more piers 110 are formed in the ground with a plurality of vertical and horizontal reinforcing bars 112 in the interior, by injecting the novel concrete mixture described above. Sections of EPS foam 114 are laid on top of the sand layer 108 and then covered with a layer of the novel sprayed concrete 116 in order to form the slab for the house. This arrangement provides an extremely stable base for the house that is easy to fabricate.

As shown in particular in FIGS. 9 and 10, a layer of concrete 118 can also be applied to the interior walls of the house, this layer being smoother than the outer layer by adjusting the aggregates in the concrete mixture. In this way, a composite structure can be formed easily and quickly that is far stronger than any other known composite structure of a comparable weight. Further, the use of the EPS as the core for the structure provides a house that is better insulated than any known house. Appropriate furnaces and air-conditioning systems can be used in order to supply the necessary heat and air-conditioning depending on the climate.

Figure 12:
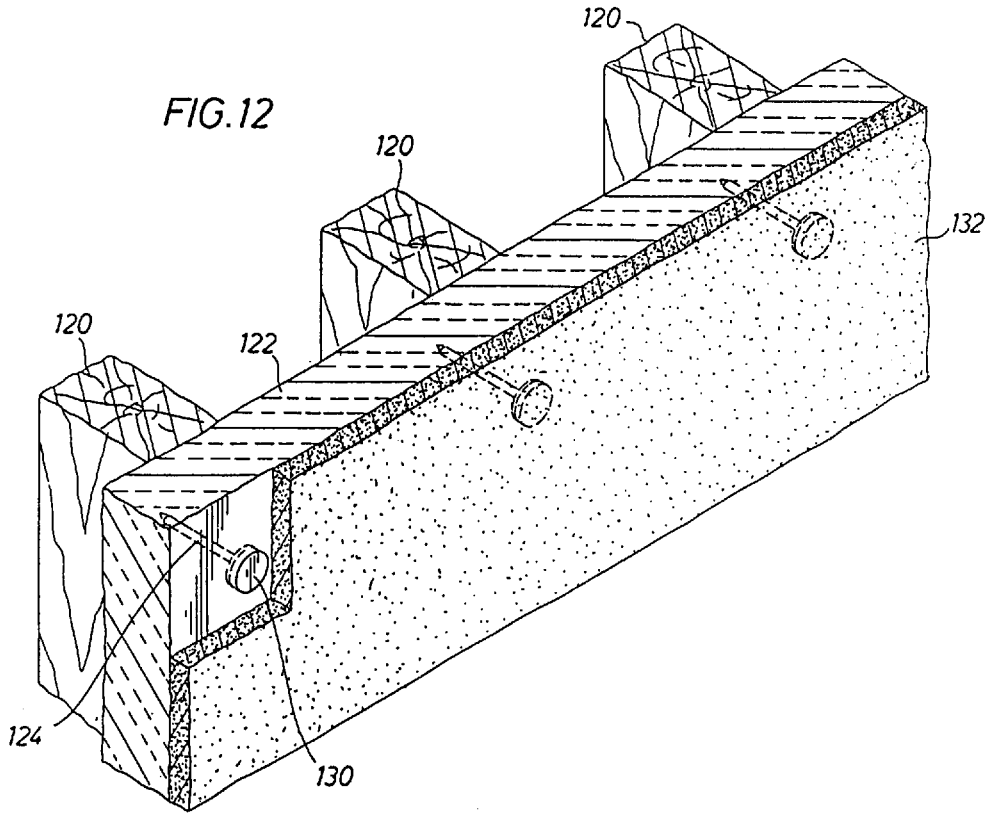
FIG. 12 is an isometric view, partially in section, showing how the inventive system can be applied as either a retrofit or to a building that has already been framed.
Figure 13:
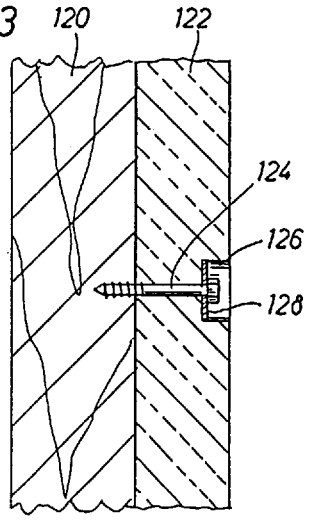
FIG. 13 is a sectional view taken along line 13—13 of FIG. 12 and showing a preferred way of connecting expanded polymer foam sections to a base material.

A significant application for the composite material is to retrofit buildings with a new outer surface or to provide the composite material to a frame which has already been constructed. For example, as shown in FIG. 12, the composite material could be applied to wooden studs 120, which are typically formed of two by fours spaced 12–18" apart. EPS panels 122 formed in 4'×8' sections and 3" thick are connected to the studs 120 by means of a series of wood screws 124 as shown in particular in FIGS. 13 and 14.

Circular cutouts 126 are formed in the outer surface of the EPS panel 122 which are 1" deep and 2" in diameter. Screw 124 is 3" long and ¼" in diameter and connects panel 122 to stud 120 through a 1½" washer 128.

Figure 14:
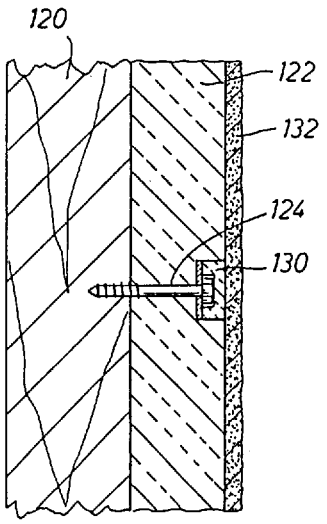
FIG. 14 is a sectional view similar to FIG. 13 after the concrete shell has been applied to the polymeric foam material.
Figure 15:
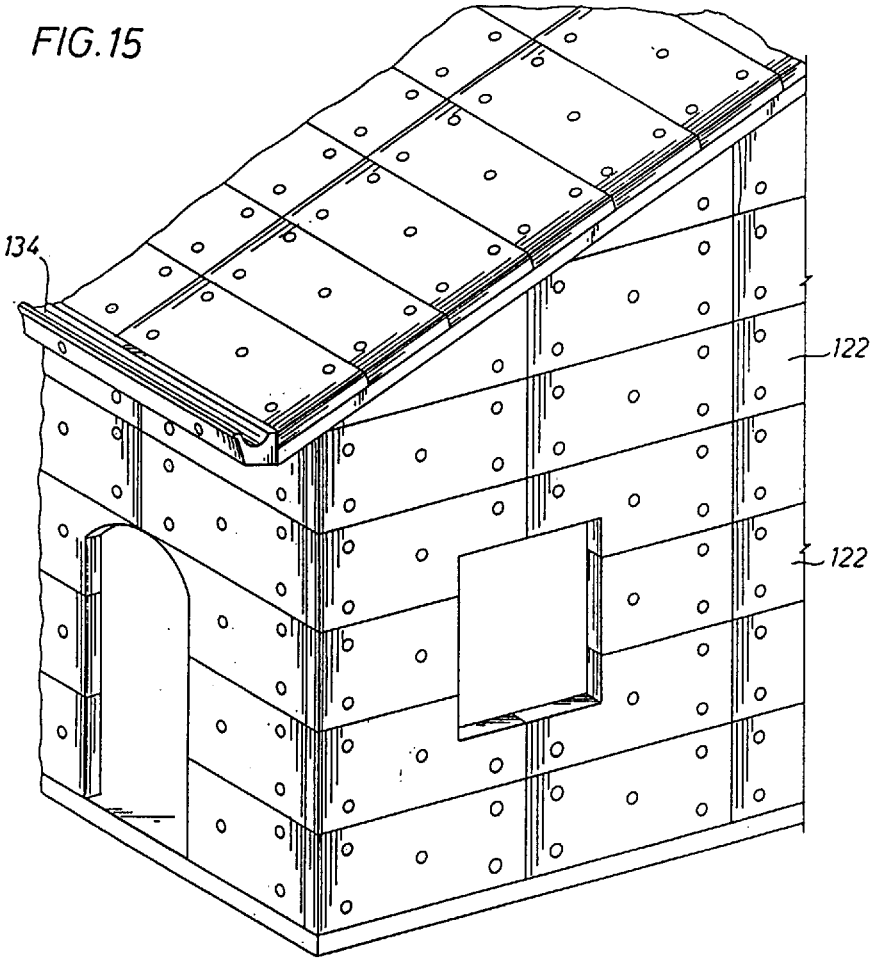
FIG. 15 is a perspective view of a house that has been covered with sections of polymeric foam material prior to being coated with the concrete shell.
Figure 18:
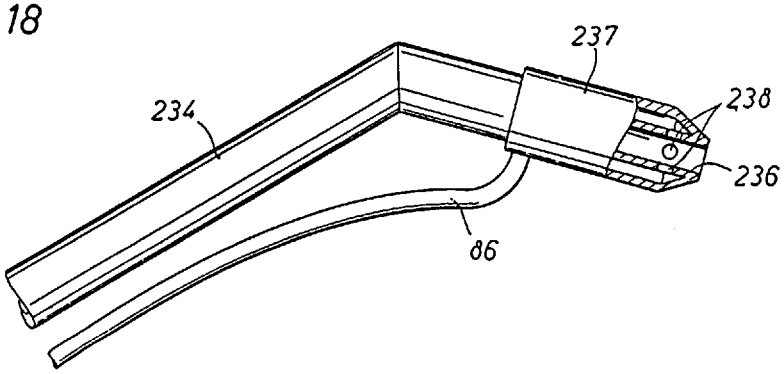
FIG. 18 is a view, partly in elevation and partly in section, of the nozzle used for spraying the inventive concrete material.

As shown in FIG. 14, after wood screw 124 is in place, a plug of EPS 130 covers the head of the screw and then a layer of the novel concrete mixture 132 is applied. As shown in FIG. 15, a number of EPS panels 122 are applied to the outer surface of the house and held in place with five fasteners per panel. The roof is also covered in addition to adding gutter sections 134 as shown. After the house is completely covered, the cement is sprayed as described above in order to provide a shell for the building.

Figure 16:
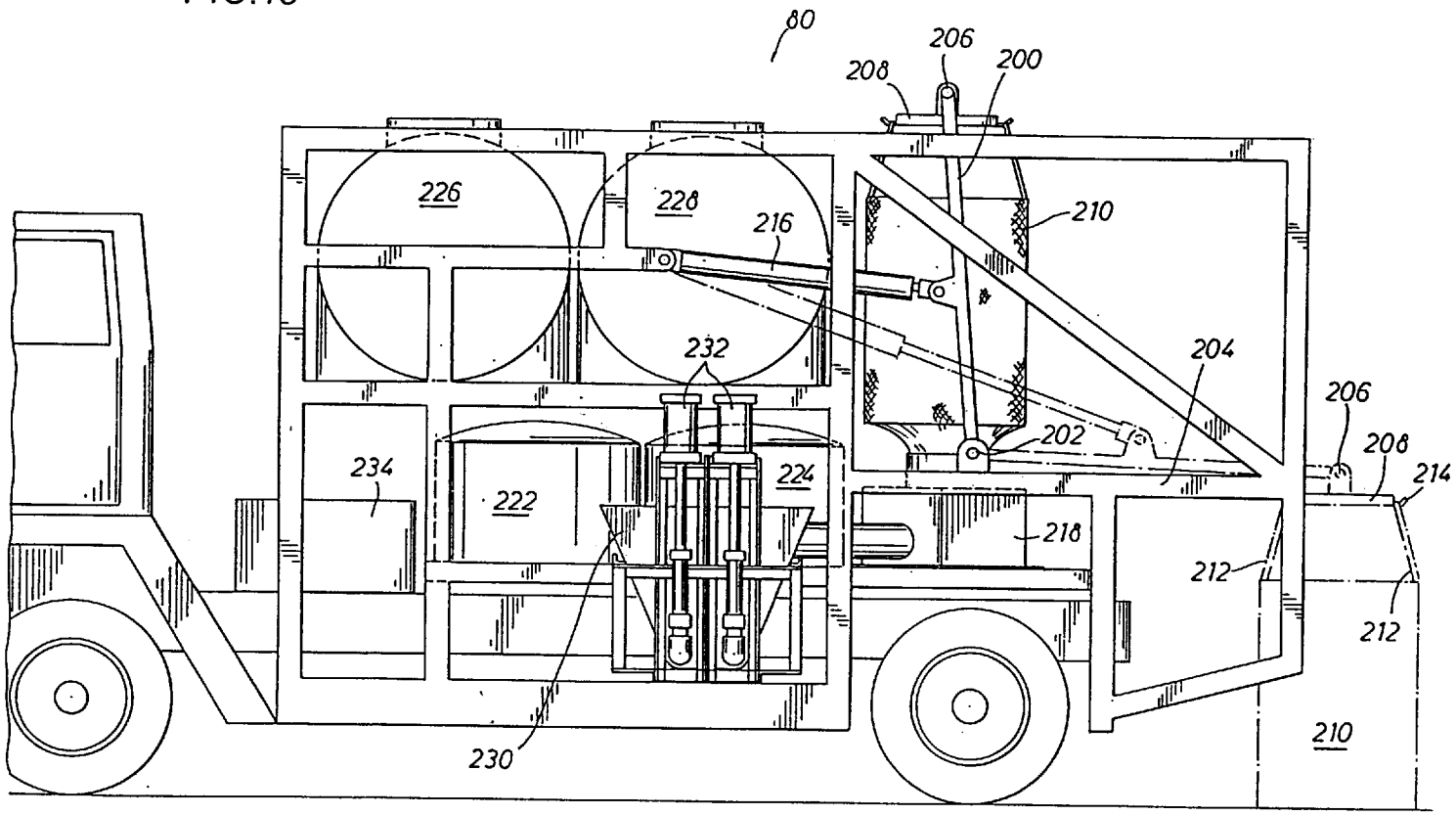
FIG. 16 is a side plan view of a truck carrying the various component parts used for spraying concrete on the house of FIG. 15.
Figure 17:
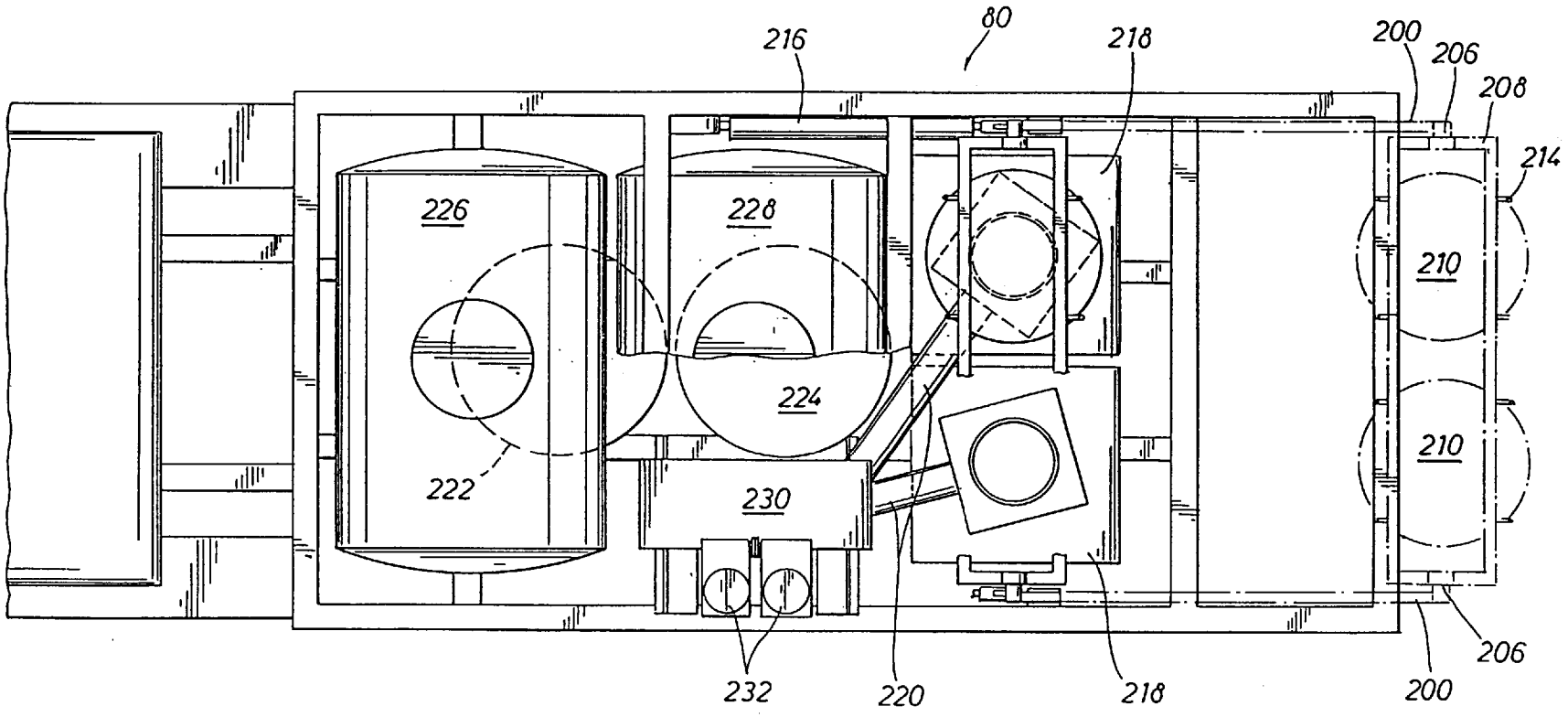
FIG. 17 is a top plan view of the truck of FIG. 16.

The novel truck 80, which is used to mix and apply the concrete coating, is shown in FIGS. 16 and 17. The truck is a standard truck that has been adapted to carry the mixing and spraying equipment. The truck has lifting apparatus at the rear that includes lifting arms 200 connected through pivot pin 202 to frame section 204. The lifting arms are connected through pivot pins 206 to a support frame 208 that is designed to lift and move one or two of bags 210 containing the dry concrete mix ingredients described above. These bags are 35"×35"×42" and formed of a woven plastic material. They have looped handles 212 that are designed to fit over hooks 214 mounted on the support frame 208. Each bag is designed to contain about 1.1 cubic yards of concrete and have been used in the past as rice containers.

Bags 210 initially rest on the ground, as shown in FIG. 16, and are lifted to an upright position through hydraulic cylinders 216 as shown in FIG. 16. When the bags are upright as shown in FIG. 16, they are positioned over a pair of hoppers 218. The bottom of the bags 210 are formed of a flexible material that is tied with a length of rope, which can easily be untied in order to empty the contents of the bag into hoppers 218. Hoppers 218 are connected to a mixing chamber through conduits 220 that contain screw conveyors (not shown) for transporting the dry mix to the mixing chamber.

The truck also includes tank 222 for holding the liquid polymer for the concrete, tank 224 for pigment, and two tanks 226, 228 for water. Tank 226 contains clear water for use in mixing the concrete, while tank 228 contains water that has a blue dye in it for cleaning the hoses and mixing equipment as described in greater detail below.

Hydraulic pumps connect all of the tanks to mixing chamber 230 so that metered amounts of each of the materials are conveyed into the mixing chamber in order to form a concrete mix. A mixing blade is provided in mixing chamber 230 so that a proper mix is maintained both prior to and during the spraying of the concrete.

As best shown in FIG. 16, hydraulic pumps 232 are connected at the bottom of mixing chamber 230 for pumping mixed concrete through hose 82 (see FIG. 1), to nozzle 84. It has been found that when a proper consistency of mix is provided, a pressure of about 75–165 lbs. per square inch is maintained in the hose. Air compressor 234 is connected to hose 86 for providing compressed air to nozzle 84.

When appropriate, compressed air is applied to nozzle 84 at the same time concrete is pumped through hose 82, an appropriate spray having a spray angle of about 45° will be ejected from the nozzle and onto house 10, as shown in FIG. 1.

When spraying is completed, a valve is switched that shuts off the flow of concrete through hose 82 and in its place allows water from tank 228 to flow through the hose for cleaning out the concrete. The water in tank 228 is tinted blue so that when the operator sees blue water emerging from nozzle 84, it will be immediately apparent to him that the hose is clean and the water can be turned off. This way, a fail-safe method of cleaning the hose is provided that insures that it will not be turned off under normal conditions until blue water is seen.

Nozzle 84 is a standard spray nozzle and includes wand 234 that is connected to an angled opening 236 that is ¼" to ½" inches in diameter. The wand is connected to hose 82 so that concrete flows through the wand and into the nozzle. Compressed air is injected into the stream of concrete from hose 86 into hollow chamber 237 and through openings 238, which are spaced around the periphery of opening 236. In this way, spray is produced that provides the benefits described above.

Thus, in accordance with this aspect of the invention, a novel composite structural material is provided for use with houses and many other types of structures as well as for retrofit applications. The use of expanded polymer foam in combination with sprayed concrete has provided a building material that is extremely strong and light in weight with energy-saving benefits unsurpassed by any other known material. The spraying of the concrete provides unexpected benefits due to the dehydration, aeration, and cooling effects on the concrete. Spraying concrete over the entire structure provides a monocoque surface that increases the strength and structural characteristics of the building.

FIGS. 19–30 illustrate the unique panel of this invention that provides a unique building block that can be used for building all sorts of structures. It is a building block that can be assembled on site in a short period of time.

Figures 19, 20, 21:
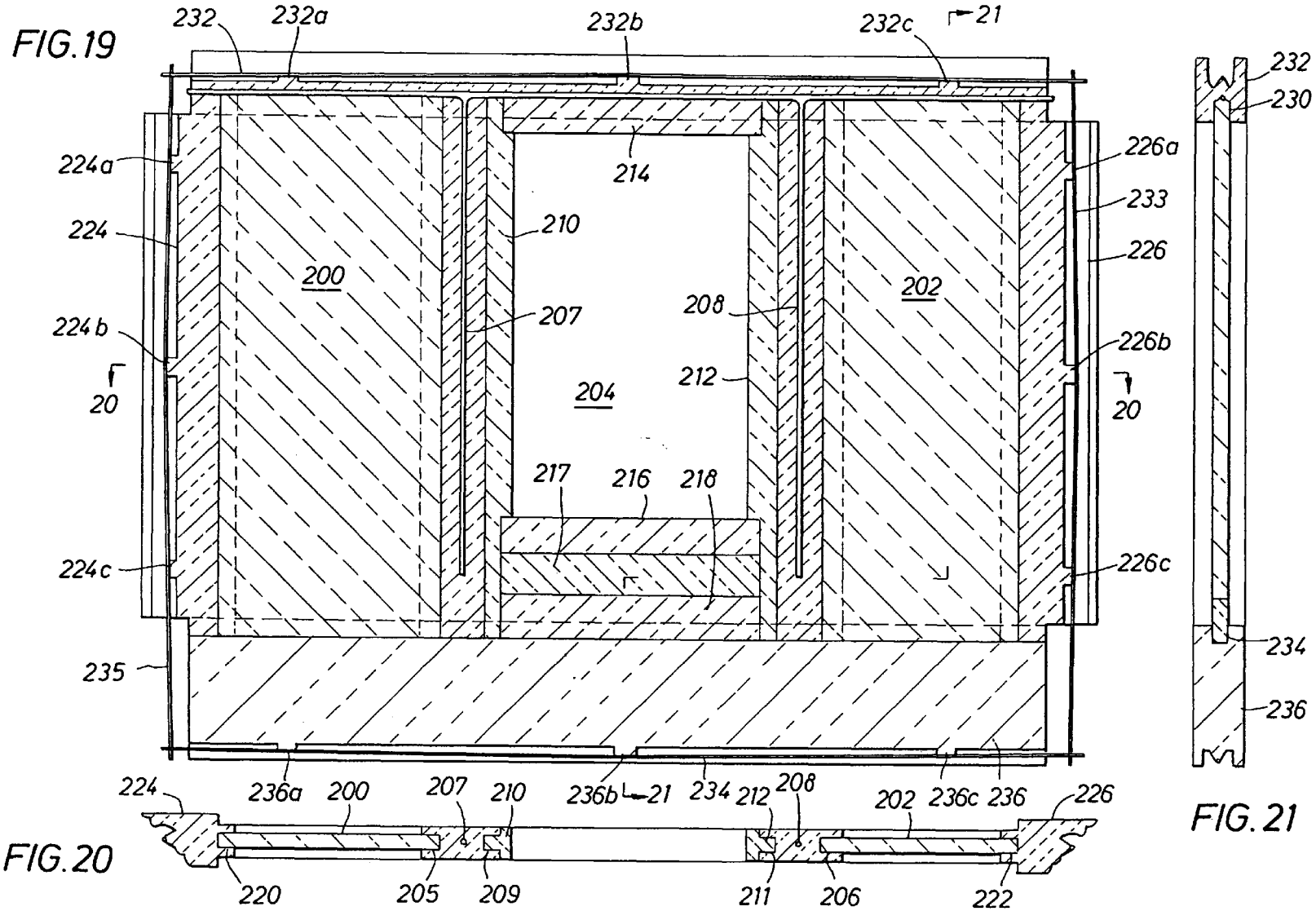
FIG. 19 is a sectional view through the panel of this invention.
FIG. 20 is a sectional view through the panel along line 20—20.
FIG. 21 is a sectional view through the panel along line 21—21.

The panel is made up pieces of EPS cut to specific sizes and shapes. The panel of FIGS. 19–21 is typical. It is designed to form one exterior wall of a house with a window in the wall. The panel includes two relatively large rectangular sheets 200 and 202 of EPS located on opposite sides of the window. The edge portions of sheets 200 and 202 adjacent the window extend into grooves 205 and 206 in connectors 207 and 208. The outer edges of sheets 200 and 202 extend into slots 220 and 222 of vertically extending tensile connectors 224 and 226.

Members 210 and 212 that are T-shaped in cross-section are positioned with the narrow portion of the T extending into longitudinal grooves 209 and 211 on the side of connectors 207 and 208 facing the window. Upper window frame 214 extends across the top of opening 204 and lower window frame 216 extends across the lower edge of opening 204. The lower frame is supported by members 217 and 218 that are located below the lower window frame.

The upper edges of panels 200, 202 and upper window frame 214 extend into groove 230 located in tensile connector 232 that extends across the top of the panel. The lower edges of panels 200, 202, 210, and 218 extend into groove 234 of lower tensile connector 236 as shown in FIG. 21.

Thus, the individual sheets of expanded polystyrene that make up the panel are held in position by tensile connectors that are located on top and bottom of the panel and along each side of the panel. The tensile connectors have common features. They each have a groove extending along one side into which the adjacent individual sheets that make up the panel can extend and another side that is designed to support rebars 233, 234, 235, and 236. Each tensile connector provides three spaced high chairs that are given the same number as the tensile connector with which they are associated plus the letters a, b, and c. In other words, the three high chairs for tensile connector 236 will be 226*a,* 226*b,* and 226*c* and the same for the rest of the high chairs. The middle high chair for each tensile connector extends outwardly from the center line of the connector further than the other two so that for the rebars to engage all three high chairs, the rebars must be bent. Thus, when the panel is assembled, the rebars are bent accordingly and the ends are wired or tack welded to the rebars extending 90° from it so that the rebars on each side exert a force on each high chair urging the tensile connectors on each side to hold the components of the panel in compression.

Figure 22:
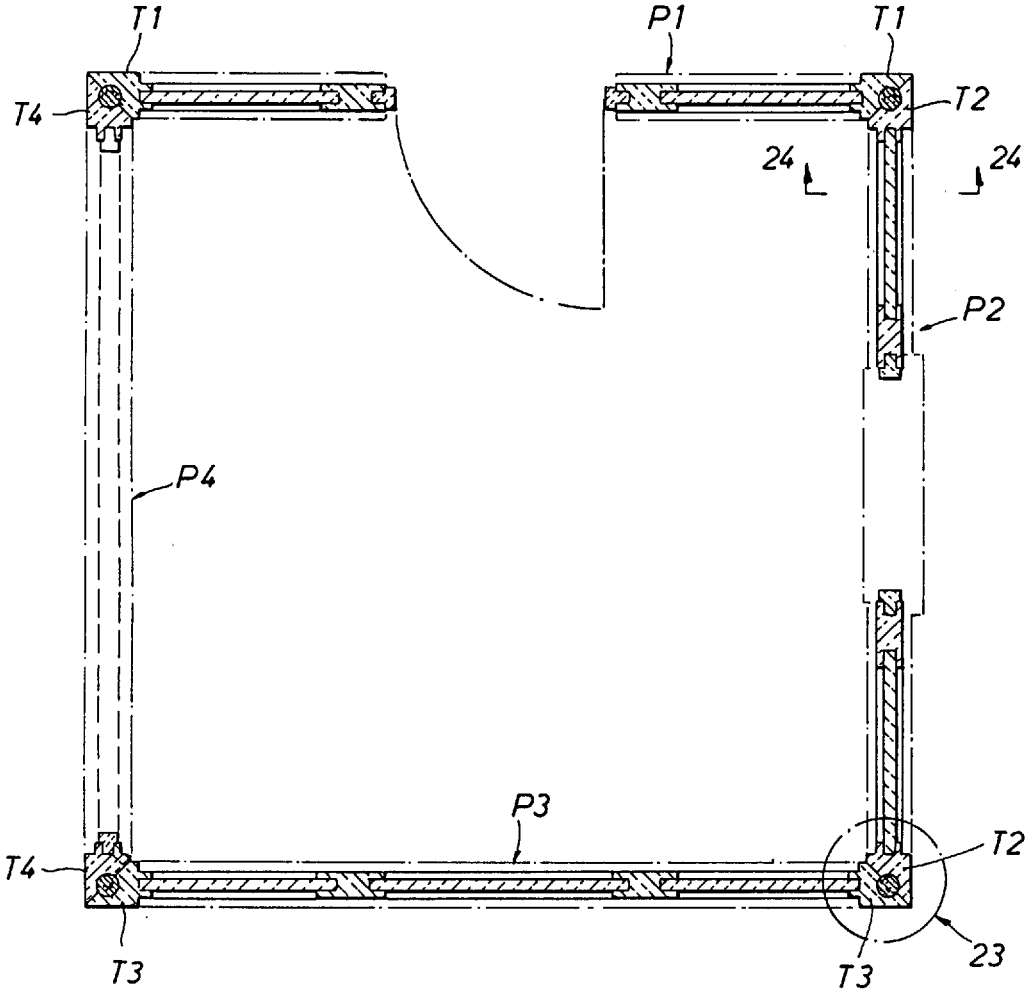
FIG. 22 is a plan view of a room having walls constructed with the panels of FIGS. 19–21.
Figure 23:
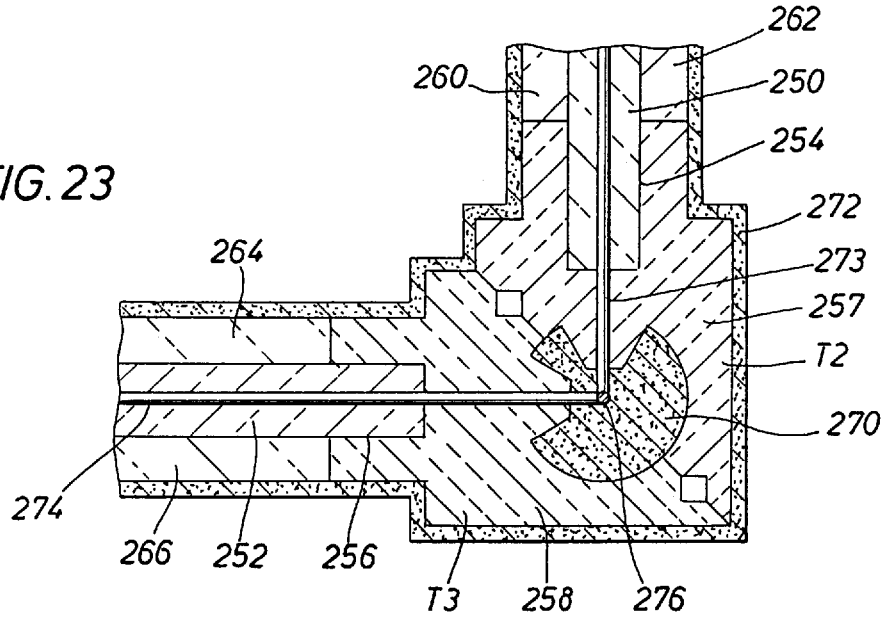
FIG. 23 is a sectional view on an enlarged scale of the connection between the two panels in circle 23.

FIG. 22 is a plan view of a room using the panels of FIGS. 19–21. Panel P1 has a door, P2 a window, the other two P3 and P4 are solid. Tensile connectors T1–T4, along the edges of each panel, hold the panels together as described above and also serve to connect the panels together to form a square room. FIG. 23 shows how tensile connector T2 is connected to T3 to form a corner of the room. Each panel includes sheets 250 and 252 of EPS that extend into grooves 254 and 256 of tensile connectors 257 and 258. Corner connectors are cut on a 45° angle so that they meet and form a 90° angle for the corner connection. Horizontal rebars 273 and 274 are welded or wired to vertical rebar 276 so that all three rebars are held in bent positions in engagement with their respective high chairs. The panels shown are provided with second and third sheets 260 and 262 glued on opposite sides of sheet 250 and sheets 264 and 266 that are glued to opposite sides of sheet 252. This provides extra strength and rigidity to the panels.

After the four panels have been assembled and the rebars connected, then opening 270 positioned between the diagonal edges of connectors 257 and 258 is filled with the concrete described above. The outer surfaces of the panels and the connectors are also coated with layers 272 of concrete.

Figure 24:
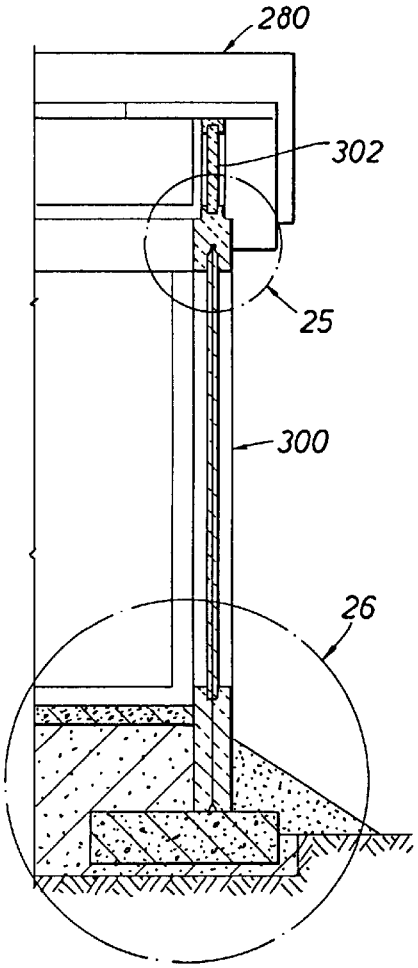
FIG. 24 is a sectional view taken along line 24—24 of FIG. 22.
Figure 25:
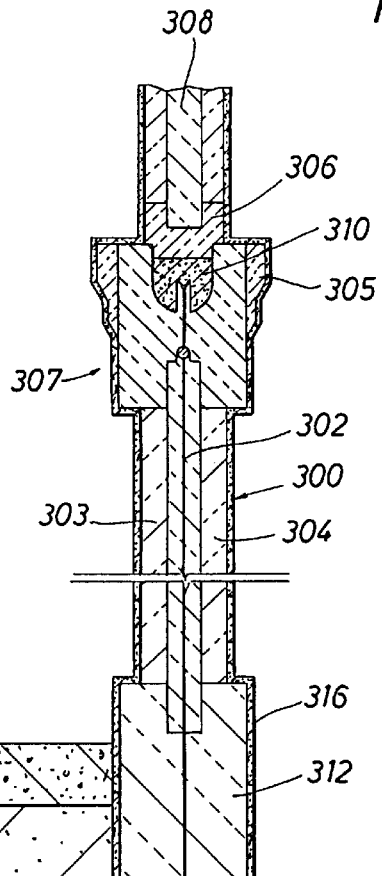
FIG. 25 is a sectional view on an enlarged scale of the portion of the wall within circle 25.
Figure 26:
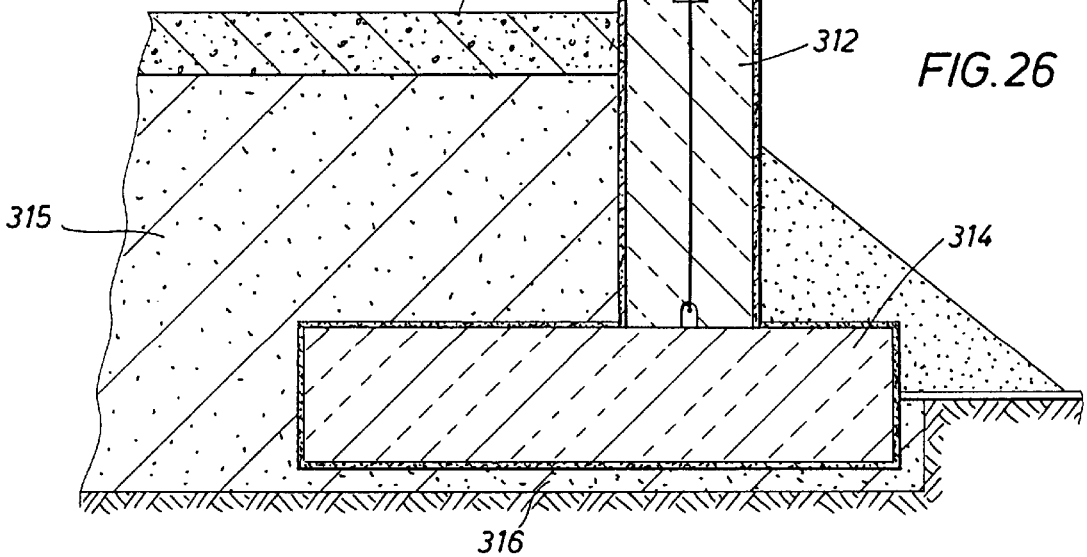
FIG. 26 is a sectional view on an enlarged scale of the portion of the foundation of the room within circle 26.

FIGS. 24–26, among other things, illustrate a unique method for forming the foundation for a building made up of the panels of this invention. As shown in FIG. 24, which is a section taken along line 24—24 of FIG. 22, panel 300 is connected at its upper end to short panel 302 that supports a portion of roof 280. It is also connected to a panel extending laterally at a 90° angle to panel 300. Panel 300 is made up of central sheet 302 of EPS with sheets 303 and 304 glued to opposite sides thereof. Tensile connector 307 is provided with molding 305 that is glued to opposite sides of the connector and upper U-shaped connector 306 that receives center sheet 308 of roof panel 302. When installed, cavity 310 in the connector is filled with concrete.

The lower portion of panel 300 includes lower tensile connector 312 that is supported on footing 314. The footing is an elongated sheet of EPS. Footing 314 is positioned in hole 315 that is formed when dirt is removed from grade down far enough to get rid of roots, etc. The bottom of the hole is then covered with sand 316 to a level sufficient to provide a level surface for the footings. At this point, a layer of the concrete described above can be sprayed over the sand and sheets of EPS placed over the bottom layer of sand. The layer of EPS sheets is not shown in this drawing.

The footing and tensile connector 312, as well as the panel 300, are then coated with layer 316 of concrete to bind all of the panels and all of the tensile members, etc. together along with the prestressed rebars like an exoskeleton to provide a structurally integrated building.

The foundation in FIG. 26 is designed to provide ballast to the building and hold it down in case of high winds. This is accomplished by filling the foundation hole with sand up to the desired level of slab 318. The sand is then leveled and slab 318 can be poured with an expansion joint between the edge of the slab and tensile member 312 so that the slab will be free to move relative to the structural framework of the building and vice versa. Lower tensile members 312 that extend around the bottom of the walls of the building provide a form for slab 318.

FIGS. 27–30 are perspective views of the panel of this invention showing the rebars, the tensile connectors and the arrangement of the sheets of EPS that form the panel.

Figure 31:
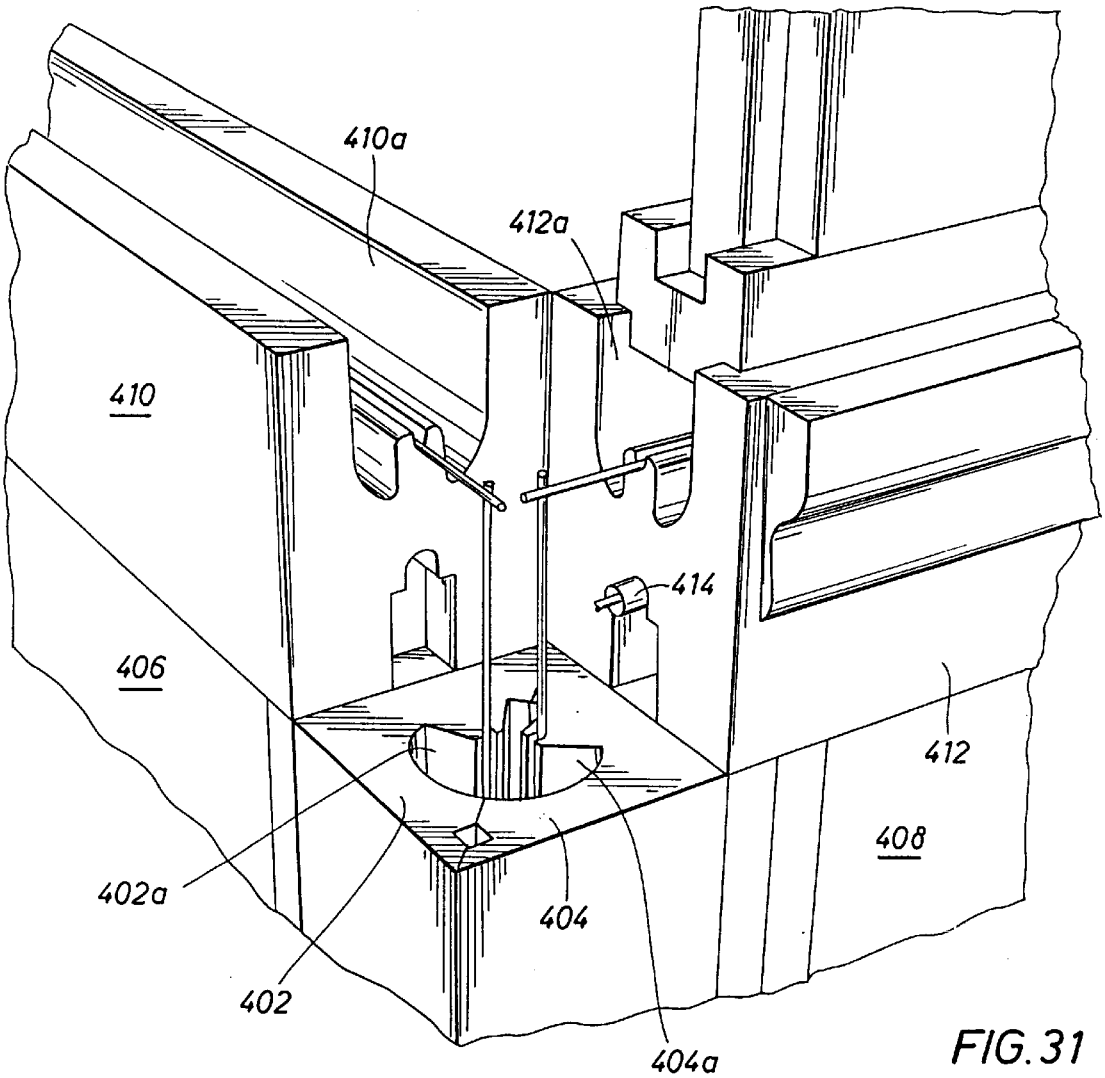
FIG. 31 is a perspective view of four tensile connectors of two panels in position to be connected together.

The panels shown in FIGS. 27–30 include tensile connectors 400 that are designed to connect to another panel extending at 90° from these panels. This is shown in FIG. 31, where tensile connectors 402 and 404 extend vertically along the side of panels 406 and 408. Horizontal tensile connectors 410 and 412 extend along the top side of panels 406 and 408. When the walls are positioned properly i.e., the walls are squared, the rebars can be wired together or tack welded to hold them bent against the high chairs. Thereafter, rectangular pieces of EPS can be positioned along the edges of connectors 402 and 404 to allow vertical cavities 402*a* and 404*b* to be filled with the concrete of this invention as well as horizontal cavities 410*a* and 412*a* of tensile connectors 410 and 412. Conduit 414 carries electrical cables.

Figure 32:
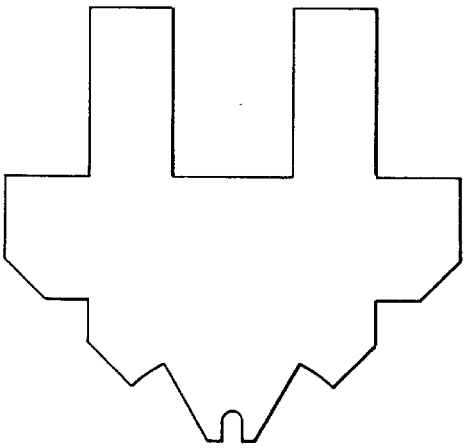
FIG. 32 is a cross-sectional view of a vertical tensile connector when four panels are connected together.

FIG. 32 shows the shape of vertical connectors when four panels are connected together.

An alternate embodiment of the construction panel of the present invention is shown in FIGS. 33–38. Typical construction panel 500, illustrated in FIG. 33A, includes a pair of relatively large rectangular EPS sheets 502, 504 positioned in a parallel relationship, whereby one face 506 of sheet 502 faces an opposing face 508 of sheet 504.

In the alternate embodiment, panels 500 include a pair of perforated steel channel studs 510 positioned at least partially within opposing faces 506, 508 of the EPS sheets adjacent the opposite ends of the sheets. Testing has indicated that in certain conditions, PVC studs may be used in place of the steel studs 510 with great success. PVC has less strength than the steel studs, but its surface may be finished with a "rough" texture that enhances its ability to bond with epoxy and the cement mixture (discussed further below). The studs hold the sheets in a parallel relationship and act as connection points for panel 500 with other panels. The ends of panel sheets 502, 504 are staggered somewhat relative to one another to facilitate the connection of panel 500 with other panels.

A spacer 512 made of either cellulose core board or EPS is positioned within opposing faces 506, 508 between studs 510. The spacer is split into two sections 512A, 512B by a third steel channel stud 514 that forms a wiring chase within the panel for electrical wiring, telephone lines, coaxial cables, and the like. The length of spacer 512 is shorter than the distance between studs 510 whereby two cavities 515A, 515B are formed between the ends of the spacer and the studs, respectively, within sheets 502, 504, for purposes that will be explained below.

The components of construction panel 500 are assembled in a jig (not shown). Epoxy is applied for bonding the surfaces of the studs and the spacer to opposing faces 506, 508 of sheets 502, 504. The epoxy includes an accelerator "kicker" that controls the time at which the epoxy becomes "active" and bonds the studs and spacer to the EPS sheets. The framed panel is heated to approximately 250° F., which enhances the bonding capability of the epoxy and also causes the epoxy to burn through and penetrate the pores of the EPS sheets, in somewhat analogous fashion to fingers within a bowling ball. This process significantly increases the surface area of sheets 502, 504 that is bonded by the epoxy. As a result, the strength of the bond between the spacer sections, the studs, and the EPS sheets far exceeds that of conventional "scale" bonding wherein only the portion of the EPS material that is flush with the bonding surface is actually bonded.

Figure 33A:
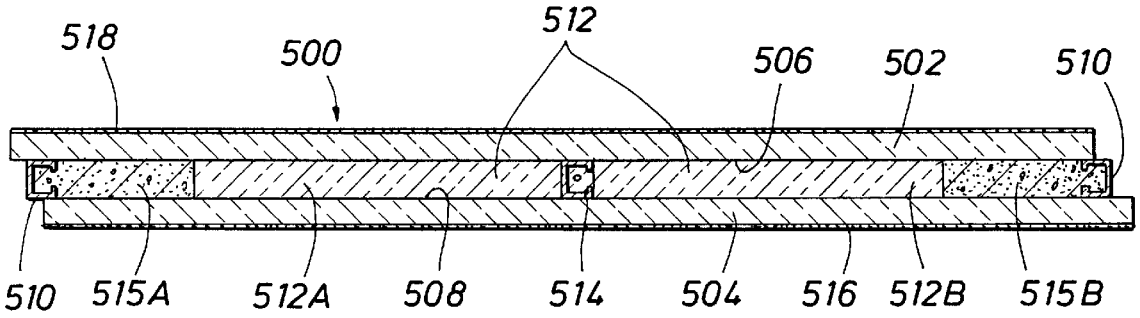
FIG. 33A is a sectional view of an alternate construction panel according to the present invention.
Figure 33B:
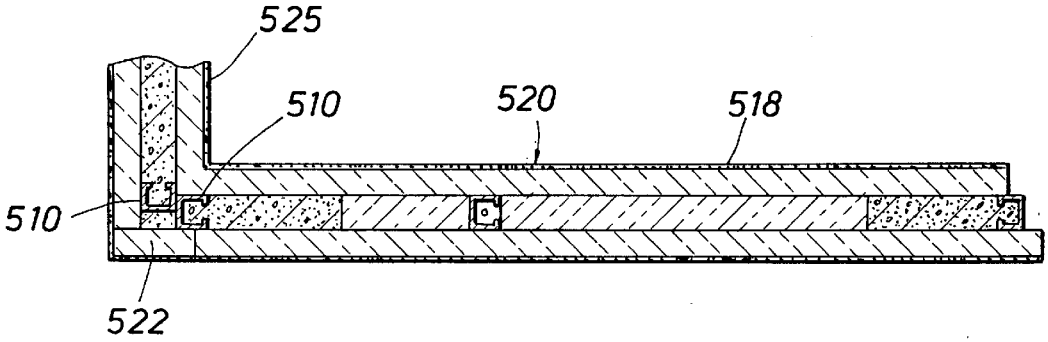

FIG. 33B illustrates a typical end wall panel 520 connected in a corner configuration to complementary panel 525. Panel 520 is a particular version of panel 500, including rightwardly opening stud 510 and narrow EPS sheet 522, both of which are framed in a jig with the panel's other components and bonded together by epoxy. Panel 525 includes upwardly opening stud 510 positioned for perpendicular engagement with stud 510 of panel 520. Panels 520 and 525 are thus assembled by placing the respective studs and EPS sheets together to form the 90° corner. In this fashion, the wall panels according to this embodiment are fitted together at the site in similar fashion to the pieces of a jigsaw puzzle.

FIGS. 33D–33F show other special configurations of construction panels 500 adapted for use in the walls of a building. FIG. 33D is a shortened assembly 540 for use as a window jamb and has no spacer. FIGS. 33E and 33F show wall panel sections having oversized square cavities 555, 565, respectively, intermediate two studs 510 for providing additional load-bearing capacities in straight and "tee" sections, 550, 560, respectively. The oversized cavities are formed of opposing steel channels 552, 562 that are connected by steel plates 554, 564.

FIG. 34 is a partial plan view of a typical wall panel assembly incorporating four panels 500 assembled to form a room or office within a building. The assembly displays the extensive use of channel studs 510 to facilitate assembly of the panels.

FIGS. 35A and 35B illustrate door and window jamb panel assemblies 570, 574 respectively.

Once the wall panels have been assembled together at the construction site, the assembly is ready for application of the concrete material in the manner described above. A 7.5 mm thick coating of the concrete is applied to the exterior surfaces of the assembly at the construction site, in addition to the 2.5 mm coating applied to each individual panel at the shop.

The bonding of the steel channel studs 510, 514 to the EPS sheets on each side of the studs insulates the studs from temperature variation. All steel is covered with a minimum of 3 cm of EPS insulation. The insulating quality of the EPS sheets is important to eliminate cracking of cementaceous material 518 sprayed to the outer sides of sheets 502, 504.

The coefficient of thermal expansion of the concrete mixture is much lower than the coefficient of thermal expansion of the metal studs, so thermal expansion/contraction of studs 510 would exceed the thermal expansion/contraction of concrete skin 518 and cause the concrete to crack if studs 510 were not insulated by EPS sheets 502, 504. In other words, the EPS sheets provide the means necessary to stabilize the temperature of studs 510, and thereby protect the monocoque concrete coating 518.

The EPS also absorbs energy to insulate the steel from shock impacts or other movement.

After the exterior surfaces of the assembled wall panels have been sprayed with the concrete mixture, the cavities within the wall panels are filled with the concrete. Referring to FIG. 34, cavities 515A, 515B are filled with the concrete mixture and the concrete flows through the perforations in studs 510 to fill adjacent cavities in the other connected panels and thus form bonds with the connected panels. Typically, construction panel systems are weakest at the points of connection between the panels. The continuity of the concrete mixture through the perforations in studs 510, and the bond of the concrete with two pairs of EPS sheets via the adjacent cavities in two joined panels, provides a strong tensile connection at the joint between the connected panels of the present invention. Thus, forces are transferred and distributed among the panels through the tensile connections across diaphragm-like studs 510. Such tensile connections are adapted for withstanding great tensile forces that would tend to pull the connected panels apart, such as the pressure differential across the walls of a structure that is experienced during a hurricane, for example. The resulting tensile connection is further believed to provide dimensional stability of the joined panels, and limit warping of the EPS sheets, both of which result in greater precision in the finished structure and a virtually "seamless" appearance at the panel interfaces. In other words, the finished form does not exhibit a "panelized" appearance. The tensile connections further enhance the protection of the wire chase channels 514. Examples of horizontal tensile connectors are shown in FIG. 34, wherein four vertical panels 500 are connected to one another.

Figure 38:
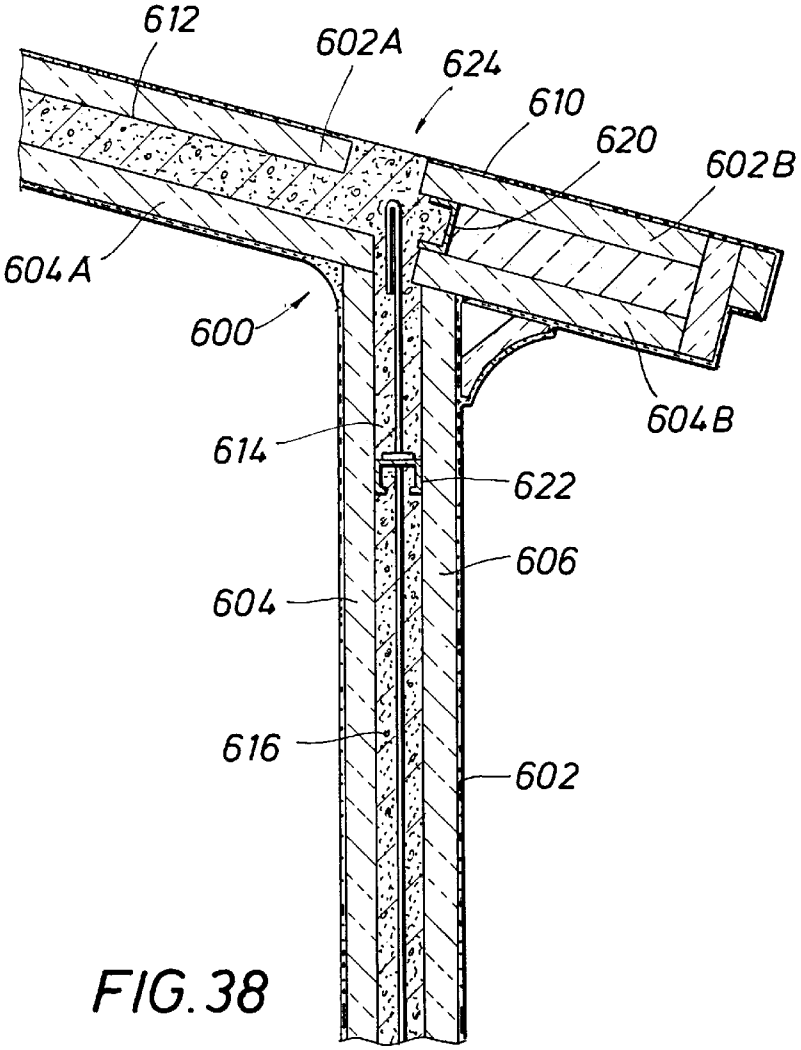
FIG. 38 displays a partial sectional view of an alternate cornice assembly formed of the alternate panels.

The benefits of the tensile connection are also apparent at the connection of panels joined at an angle, such as the joining of a wall panel to a roof panel, which is commonly know as a "moment connection." Such moment connections are similarly strengthened by the continuity of the concrete mixture through the perforations of the studs connecting the panels together, as is shown in FIGS. 36 and 38 (discussed further below). The moment connections of this invention are believed to be particularly suited for resisting lift forces applied to the roof of a building that tend to rip the roof off, such as those forces resulting from a pressure differential across the roof caused by severe winds, such as during a hurricane.

Figure 33C:
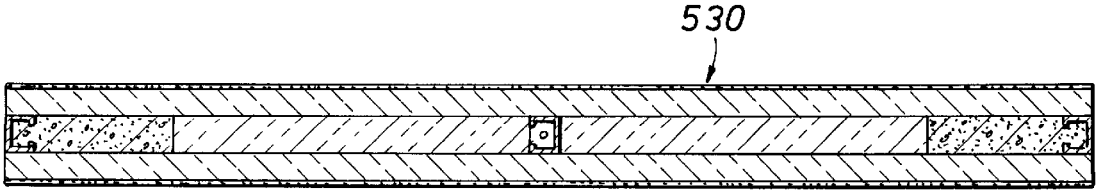

Roof panel 530, shown in FIG. 33C, is another example of a particular version of panel 500. The EPS sheets and spacer of roof panel 530, however, are somewhat thicker than the corresponding EPS sheets and spacer of a typical wall panel for added strength across the thickness of the panel. Initially, a thin coating of the concrete mixture is applied at the shop to the finished roof panels. A 5 mm coating of the cementaceous material is applied topside and a 7.5 mm coating is applied underside to the individual roof panels. The roof panels are later placed side-by-side on the roof frame of the building and sprayed as an assembly with a second coating of the concrete at the construction site. The assembled roof panels have a 10 mm thick coating of the concrete applied topside and a 12.5 mm coating applied underside at the site.

FIG. 36 shows a ridge panel assembly, wherein upstanding wall panel 581 vertically supports two outwardly sloping panels 583A, 583B. Upstanding panel 581 includes stud 510, wiring chase 514, and cavity forming channel stud 582. Stud 582 stiffens wall panel 581, and provides greater strength for bearing "live loads" on the roof of the structure prior to the time the concrete mixture is poured into the cavity within stud 582. Panels 583A, 583B are positioned such that a wedge-shaped cavity is formed between them. Stud 582 is perforated at its upper end, such that concrete poured into the cavity between panels 583A, 583B will flow downwardly into the cavity within stud 582, connecting the two cavities and forming a moment connection. Steel rebar 584 (not shown) in the shape of an inverted "J" may also be positioned through these cavities to enhance the strength of the moment connection at the ridge.

Figure 37:
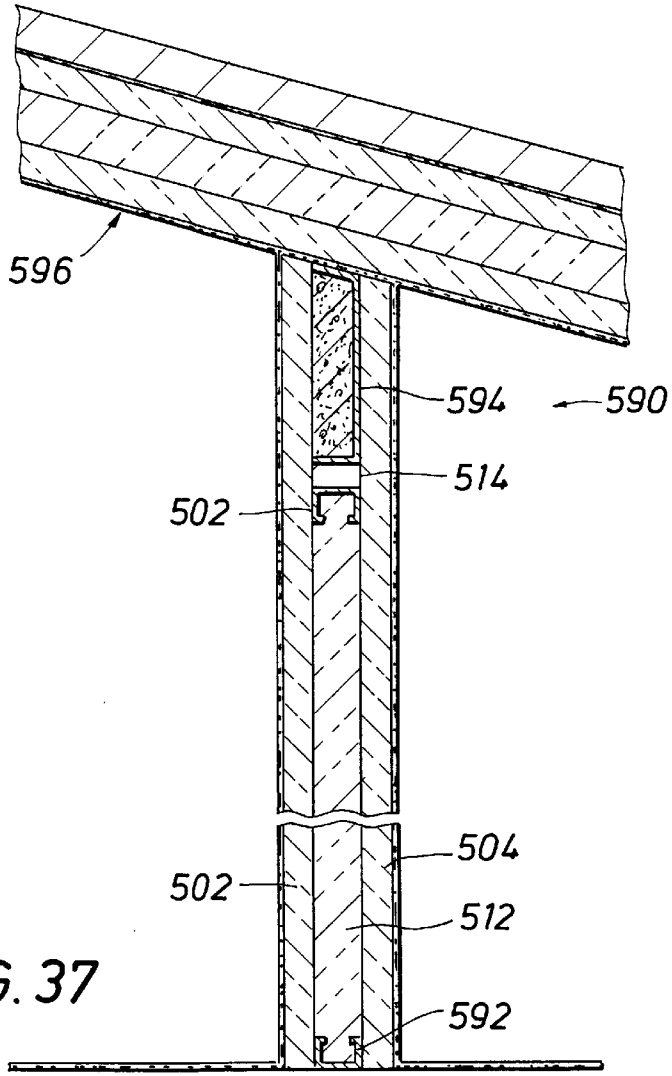
FIG. 37 is a broken sectional view of a cornice assembly constructed of the alternate panels.

FIG. 37 shows a broken view of a cornice panel assembly. Spacer 512 is set within channel track 592 between EPS sheets 502, 504 at the floor of the building. Steel channel 594 stiffens panel 590 as the roof is being assembled. Once the roof and cornice structure are fully assembled, channel 594 is filled with the concrete mixture by punching a hole in EPS sheet 502 and pumping the concrete into the cavity within channel 594. The concrete mixture is then sprayed onto the outer surfaces of EPS sheets 502, 504 and upper panel 596 to bond the cornice assembly in place.

FIG. 38 illustrates an alternative cornice assembly 600 having a vertical panel 602 with EPS sheets 604, 606, and an upper inclined panel 610 having EPS sections 602A, 602B, and 604A, 604B. The EPS sheets of panel 610 are split between sections 604A and 604B, respectively, to enable cavity 612 to communicate with cavity 614. Cavity 614 also communicates with cavity 616 through pores in channel stud 622. Steel reinforcing bar 624 is inserted through the opening formed between section 602A and 602B, and is mounted in stud 622 in a conventional manner. Bar 624 reinforces the moment connection established by the cement that fills cavities 612, 614, and 616.

It will be apparent to those skilled in the art that the present invention will greatly ease the workload of building construction, as two workers can easily lift and set the panels into place. As described above, the panel assemblies will exhibit naturally strong joints, and the overall assembly demonstrates remarkable strength for its weight.

From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A sprayable concrete mixture, comprising solids in the amount of:

(a) 30–45% by weight of silica selected from the group consisting of quartz, flint, or sand;

(b) 5–15% by weight of silicates sized to pass an ASTM standard No. 4-sized mesh screen;

(c) 20–30% by weight of marble aggregate of varying size ranging from powder up to 0.1";

(d) 20–25% by weight of Portland cement;

(e) 0–10% by weight lime; and (f) 0–1% by weight of polypropylene monofilament fibers; and further including sufficient water to form a sprayable concrete mixture.

2. The concrete of claim 1, further including vinyl acrylic polymer fortifier of a volume not more than the volume of water.

* * * * *